US012298098B2

(12) United States Patent
Geissele et al.

(10) Patent No.: US 12,298,098 B2
(45) **Date of Patent: *May 13, 2025**

(54) FIREARM BARREL HAVING AT LEAST ONE BARREL GAS PORT AND METHOD OF MANUFACTURING THE SAME

(71) Applicant: WHG Properties, LLC, North Wales, PA (US)

(72) Inventors: William Geissele, Lower Gwynedd, PA (US); Frank Robinson, Schwenksville, PA (US); Dave Duhaime, Ivyland, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/419,409

(22) Filed: Jan. 22, 2024

(65) Prior Publication Data

US 2024/0377149 A1 Nov. 14, 2024

Related U.S. Application Data

(63) Continuation of application No. 17/662,027, filed on May 4, 2022, now Pat. No. 11,920,885.

(51) Int. Cl.
*F41A 5/26* (2006.01)
*F41A 21/18* (2006.01)

(52) U.S. Cl.
CPC ..... *F41A 5/26* (2013.01); *F41A 21/18* (2013.01)

(58) Field of Classification Search
CPC ..... F41A 5/18–30; F41A 21/28
(Continued)

(56) References Cited

U.S. PATENT DOCUMENTS 1,628,896 A 5/1927 Medearis
3,808,943 A 5/1974 Kelly
(Continued)

FOREIGN PATENT DOCUMENTS

FR 1168622 A 12/1958
GB 2230846 A 10/1990

OTHER PUBLICATIONS

Shooters' Forum, AR gas port borescope question, [retrieved from Internet May 20, 2022] https://forum.accurateshooter.com/threads/ar-gas-port-borescope-question.4049954/, Nov. 2021, (7 pages).
(Continued)

*Primary Examiner* — Bret Hayes
(74) *Attorney, Agent, or Firm* — Alston & Bird LLP

(57) ABSTRACT

Various embodiments are directed to a barrel for a firearm. In various embodiments, a barrel comprises an inner surface defining a bore configured to guide a projectile as the projectile is propelled through the bore by pressurized gas; and a barrel gas port having a gas port depth extending between a port entrance defined by the inner surface of the barrel and a port exit, wherein the barrel gas port is configured to fluidically communicate with the bore and an action of the firearm; wherein the port entrance defines a length dimension defined parallel to a longitudinal axis of the barrel and a width dimension defined perpendicular to the length dimension; and wherein the length dimension of the port entrance is greater than the width dimension of the port entrance. Various embodiments are directed to a firearm comprising the exemplary barrel.

20 Claims, 16 Drawing Sheets

(58) Field of Classification Search
USPC ..... 89/193
See application file for complete search history.

(56) References Cited

U.S. PATENT DOCUMENTS

| | | | | |
|---|---|---|---|---|
| 4,058,050 | A | 11/1977 | Brouthers | |
| 4,102,242 | A | 7/1978 | Liedke | |
| 4,505,183 | A | 3/1985 | Grehl | |
| 4,942,801 | A | 7/1990 | Schuemann | |
| 5,844,162 | A | 12/1998 | Renner | |
| 8,485,082 | B1 | 7/2013 | Masaki | |
| 10,274,273 | B1 | 4/2019 | Potter | |
| 11,920,885 | B2 * | 3/2024 | Geissele | F41A 21/18 |
| 2004/0237766 | A1 | 12/2004 | Cornils | |
| 2016/0161200 | A1 | 6/2016 | Windauer | |
| 2017/0198997 | A1 | 7/2017 | Geissele | |
| 2018/0031343 | A1 | 2/2018 | Caudle | |
| 2022/0113099 | A1 | 4/2022 | Geisselle | |

OTHER PUBLICATIONS

Cast Boolits, AR15 gas port burr removal? [retrieved from Internet May 20, 2022] https://castboolits.gunloads.com/showthread.php?402444-AR15-gas-port-burr-removal, May 20, 2020 (11 pages).
Practical Machinist, Gunsmithing, AR-15 Gas Port in Barrel Question, [retrieved from Internet May 20, 2022] https://www.practicalmachinist.com/vb/gunsmithing/ar-15-gas-port-barrel-question-203277/, Apr. 27, 2010 (6 pages).
PhpBB The Home Machinist!, Reverse chamfering gas port holes. [retrieved from Internet May 20, 2022] http://chaski.org/homemachinist/viewtopic.php?f=10&t=82991#p158138, Oct. 11, 2019 (2 pages).
Cogsdill, Deburring Tools, Both Sides in One Pass [retrieved from Internet May 20, 2022] https:/cogsdill.com/products/deburring-tools/, 2017 (10 pages).
Barrel Erosion, Feb. 1, 2023, 1 page.
Office Action issued for European Patent Application No. 23166502.7 dated Aug. 22, 2024 (5 pages).

* cited by examiner

FIREARM BARREL HAVING AT LEAST ONE BARREL GAS PORT AND METHOD OF MANUFACTURING THE SAME

CROSS-REFERENCE TO RELATED APPLICATIONS

This patent application is a continuation of U.S. patent application Ser. No. 17/662,027, filed May 4, 2022, which is incorporated herein by reference in its entirety.

FIELD OF THE INVENTION

The inventive concepts disclosed herein relate to assemblies for gas-actuated firearms in which propellant gas generated by the discharge of the firearm is used to actuate an internal mechanism that automatically reloads the firearm, and firearms that include such assemblies.

BACKGROUND

Industrial and commercial applications may use firearms having gas systems that facilitate the discharge of a projectile from a barrel of the firearm upon firing. In particular, a barrel of a firearm may use a barrel gas port defined within the barrel to fluidically connect the bore of the firearm with the gas system in order to enable operation of the firearm. Through applied effort, ingenuity, and innovation, Applicant has solved problems relating to barrel gas ports by developing solutions embodied in the present disclosure, which are described in detail below.

BRIEF SUMMARY

Various embodiments are directed to a barrel for a firearm and method of manufacturing the same. In various embodiments, a barrel for a firearm may comprise A barrel for a firearm, comprising: an inner surface defining a bore configured to guide a projectile as the projectile is propelled through the bore by pressurized gas; and a barrel gas port having a gas port depth extending between a port entrance defined by the inner surface of the barrel and a port exit, wherein the barrel gas port is configured to fluidically communicate with the bore and an action of the firearm; wherein the port entrance defines a length dimension defined parallel to a longitudinal axis of the barrel and a width dimension defined perpendicular to the length dimension; and wherein the length dimension of the port entrance is greater than the width dimension of the port entrance.

In various embodiments, the length dimension of the port entrance may be greater than a second length dimension of the barrel gas port defined parallel to the longitudinal axis between the port entrance and the port exit. In certain embodiments, the barrel gas port comprises a transition region having a transition region length defined at the port entrance such that the length dimension of the port entrance is defined in part by the transition region length, wherein the transition region length dimension of the port entrance is two times to three times greater than the second length dimension. In certain embodiments, a center point of the length dimension of the port entrance may be located closer to a muzzle end of the barrel than a center point of the second length dimension of the barrel gas port. In certain embodiments, the width dimension of the port entrance may be equal to a second width dimension of the barrel gas port defined at a location of the second length dimension. In certain embodiments, a width dimension of the port entrance may be greater than a second width dimension of the barrel gas port defined at a location of the second length dimension.

In various embodiments, the barrel gas port may define a flow region defining a constant cross-sectional area for at least a portion of a length of the barrel gas port and a transition region between the port entrance and the flow region. In certain embodiments, the transition region may comprise a larger surface area within the barrel gas port on a muzzle side of the barrel gas port than on an action side of the barrel gas port. In certain embodiments, the transition region may define a surface angle at a location between the port entrance and the flow region, and wherein the surface angle is between an angle of the bore and an angle of a wall surface of the barrel gas port in the flow region. Further, a transition region muzzle-side wall surface of the transition region may comprise a complex curvature defined by a first radius of curvature defined in a first plane and a second radius of curvature defined in a second plane. Further still, a transition region action-side surface may comprise a partially cylindrical shape corresponding to a shape of a flow region action-side surface adjacent thereto at a first port depth, and wherein the transition region muzzle-side surface transitions to a partially cylindrical shape corresponding to a shape of a flow region muzzle-side surface adjacent thereto at a second port depth, wherein the first port depth and the second port depth are measured from the port entrance, wherein the second port depth is greater than the first port depth, and wherein the barrel gas port defines a cylindrical shape at the second port depth.

In various embodiments, the barrel gas port may extend through the barrel between the port entrance defined in the bore and the port exit defined by an outer surface of the barrel. In various embodiments, the barrel may comprise a plurality of barrel gas ports, including the barrel gas port, in fluid communication with the bore. In certain embodiments, each of the plurality of barrel gas ports may comprise a respective port entrance defined by the inner surface, wherein each of the respective port entrances defines a respective length dimension and a respective width dimension, wherein the respective length dimension of each of the respective port entrances is greater than the respective width dimension of each respective port entrance. In certain embodiments, each of the plurality of barrel gas ports may be defined at a same axial location along a length of the barrel. In certain embodiments, the barrel may further comprise one or more rifling elements along the inner surface. In certain embodiments, the one or more rifling elements may comprise a rifling land and a rifling groove defined along the inner surface of the barrel, and wherein the port entrance of the barrel gas port is defined on one of the rifling land, the rifling groove, and partially on both the rifling land and the rifling groove. In various embodiments, the gas port depth may be defined in a direction at least substantially perpendicular to a bore length of the bore such that the barrel gas port is at least substantially perpendicular to the bore of the barrel.

Various embodiments described herein are directed to a firearm comprising the barrel described here. In certain embodiments, the firearm may further comprise an action and a gas block engaged with the barrel at a location of the port exit of the barrel gas port, wherein the gas port is configured to fluidically connect the action of the firearm with the bore via the barrel gas port.

BRIEF DESCRIPTION OF THE DRAWINGS

Reference will now be made to the accompanying drawings, which are not necessarily drawn to scale, and wherein.

DETAILED DESCRIPTION

Figure 1:
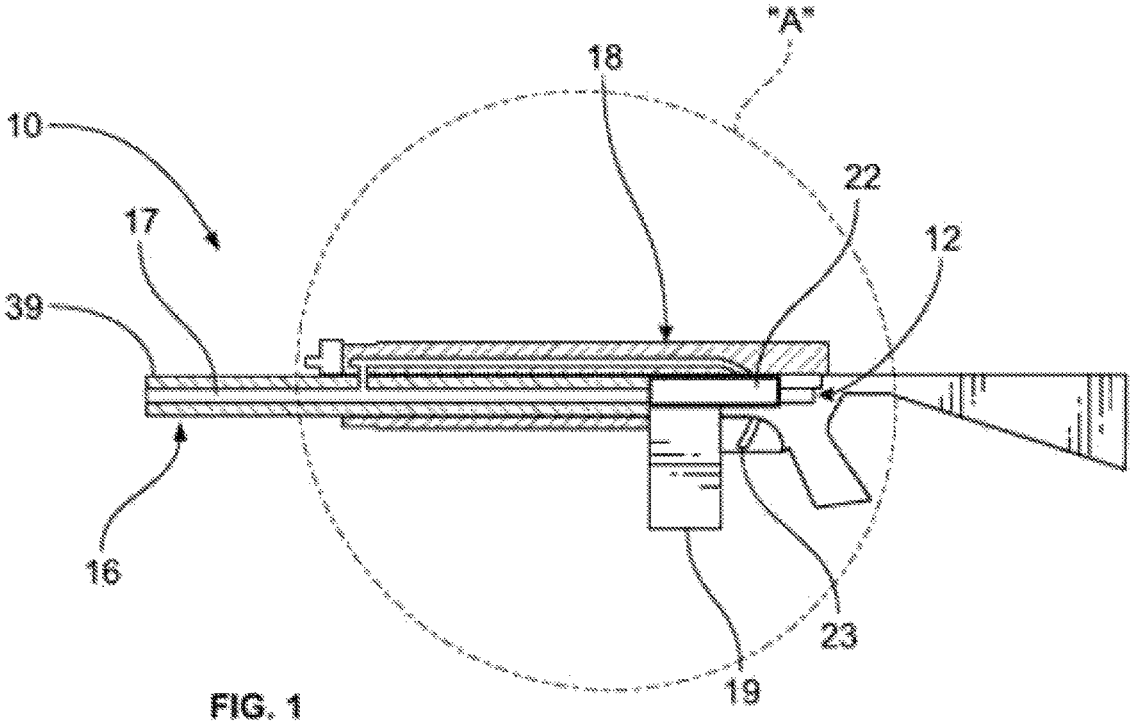
FIG. 1 is a cross-sectional, schematic side view of an exemplary firearm equipped with a barrel and gas block assembly as described herein.

The present disclosure more fully describes various embodiments with reference to the accompanying drawings. It should be understood that some, but not all embodiments are shown and described herein. Indeed, the embodiments may take many different forms, and accordingly this disclosure should not be construed as limited to the embodiments set forth herein. Rather, these embodiments are provided so that this disclosure will satisfy applicable legal requirements. Like numbers refer to like elements throughout.

It should be understood at the outset that although illustrative implementations of one or more aspects are described herein and illustrated in the accompanying figures, the disclosed assemblies, systems, and methods may be implemented using any number of techniques. The disclosure should in no way be limited to the illustrative implementations, drawings, and techniques illustrated below, but may be modified within the scope of the appended claims along with their full scope of equivalents. While values for dimensions of various elements are disclosed, the drawings may not be to scale.

The words "example," or "exemplary," when used herein, are intended to mean "serving as an example, instance, or illustration." Any implementation described herein as an "example" or "exemplary embodiment" is not necessarily preferred or advantageous over other implementations.

Tactical rifles and other types of firearms, including but not limited to AR-15 platform rifles, are commonly equipped with a gas system configured to capture energy, in the form of high-pressure gas, generated by the discharge of the firearm. The energy is used to activate and cycle a mechanism, or action, that automatically reloads the firearm. Gas-actuated firearms according to the various embodiments discussed herein may include one or more barrel gas ports in the barrel to cause pressurized gas to operate portions of the action of the firearm. In general, the gas system may be utilized to discharge a projectile from a barrel of the firearm by propelling the projectile down the barrel of a firearm using a propellant gas. Immediately after discharge, such propellant gases can expand, causing the projectile to expand against the adjacent interior surface of the barrel as a result of the pressure of the expanding gas behind it. These propellant gasses drive the projectile down the barrel and, upon reaching the barrel gas port(s) direct pressurized gas back to the action to cycle the rifle.

When the projectile passes a barrel gas port arranged at an axial position along the barrel length of the barrel, this expansion will push some of the projectile into the barrel gas port or otherwise cause the projectile to impinge on the barrel gas port, causing a portion of the projectile to destructively engage the barrel gas port (e.g., an edge of the port entrance defined by the inner surface of the barrel) and, in turn will shave off material from the projectile and/or damage the barrel. The resulting imbalance in the projectile can reduce the gyroscopic stability of the projectile, causing the projectile to deviate from its intended flight path, thereby reducing shooting accuracy. Further, repeated engagement of discharged projectiles with the barrel gas port may result in steady, or even rapid, deterioration of the barrel, which can lead to a reduced service lifespan.

The present disclosure comprises a barrel for a firearm comprising one or more barrel gas port(s) configured to fluidically communicate with a bore and an action of the firearm and having a port entrance defined by the inner surface, wherein a length dimension of the port entrance defined parallel to a longitudinal axis of the barrel is greater than the width dimension of the port entrance defined perpendicular to the length dimension. For example, in various embodiments, the length dimension of the port entrance is greater than a second length dimension of the barrel gas port defined parallel to the longitudinal axis at a location defined between the port entrance and the port exit. An exemplary barrel gas port may define a flow region defining a constant cross-sectional area for at least a portion of a length of the barrel gas port, and a transition region defined between the port entrance and the flow region. As described herein, the transition region of the barrel gas port described herein may be configured to facilitate the traveling of a discharged projectile along a bore without the projectile physically engaging a barrel gas port having a port entrance defined along an inner surface of the barrel. For example, by asymmetrically removing at least a portion of material from a portion of the barrel wall at a muzzle side of the barrel gas port (e.g., a muzzle-side edge of the port entrance closest to the muzzle) so as to define a material recess that functions to increase the length dimension of the port entrance in a direction parallel to the longitudinal axis of the barrel, embodiments of the present disclosure substantially reduce the engagement of the projectile with the barrel gas port during discharge of the projectile. Accordingly, embodiments of the present disclosure facilitate reduction in the operational inaccuracies and/or inefficiencies caused by the physical alteration to the projectile during the discharge thereof, and, further, increases the lifespan of the firearm by avoiding the undesirable interaction of the projectile with the barrel gas port that causes premature ware to the firearm.

Figure 2:
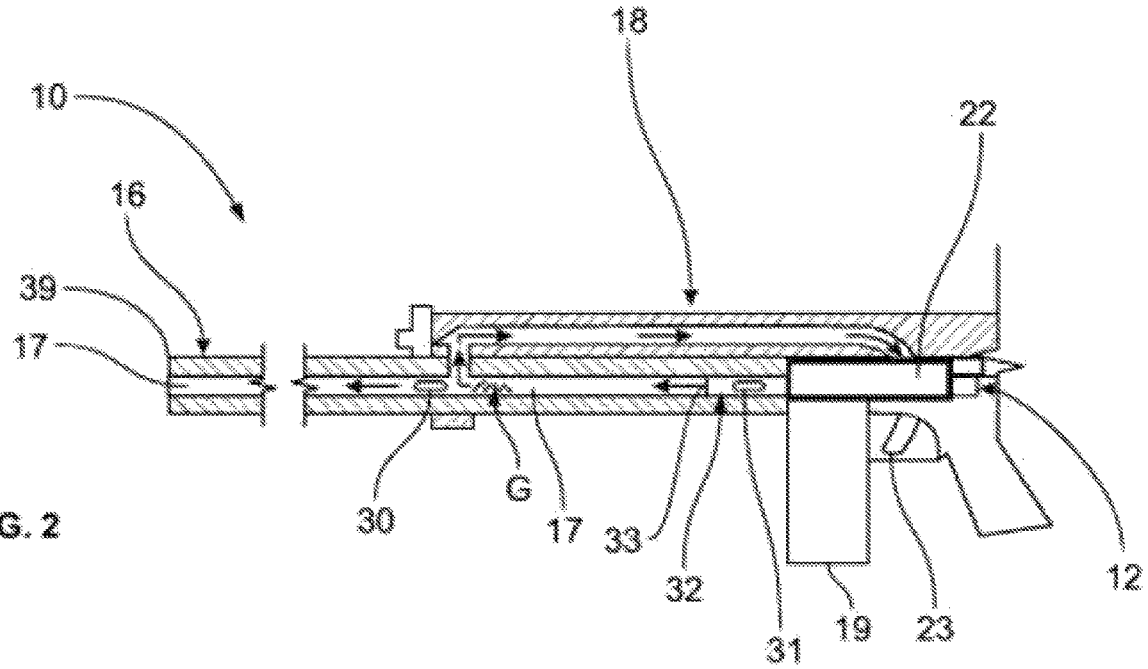
FIG. 2 is a magnified view of the area designated "A" in FIG. 1.

FIGS. 1 and 2 schematically depict a gas-operated firearm 10 according to various embodiments discussed herein, such as an AR-15 platform rifle. The firearm 10 may be a semi-automatic firearm (e.g., a rifle) that fires a projectile 30 (e.g., bullet). The firearm 10 is equipped with a gas system (e.g., including a gas block 100 and a gas conduit 18) configured to capture energy generated by the firing of the projectile 30, and to use the captured energy to cycle a mechanism at the action that automatically reloads and cock the hammer of the firearm 10 (e.g., a bolt carrier group, trigger assembly, disconnector, firing pin, hammer, buffer, and/or the like as would be appreciated by the person skilled in the art in light of the present disclosure). Specific details of the example firearm 10 are presented for exemplary purposes only. Various inventive principles disclosed herein can be applied to other types of firearms, including but not limited to other types of rifles, including automatic rifles, shotguns, and pistols utilizing one or more barrel gas ports as discussed herein.

In the depicted embodiment, the firearm 10 includes a receiver 12, a barrel 16, and a magazine 19 that holds unfired rounds of ammunition or cartridges 32. Each cartridge 32 may include a casing 31 with a projectile 30, a primer (not shown), and a propellant (also not shown) all housed within the casing 31. The barrel 16 may include a chamber 33 that receives and houses an individual cartridge 32 immediately prior to firing, as shown in FIG. 2. The barrel 16 need not be a single integral piece.

The depicted receiver 12 includes a trigger mechanism and an action 22. The trigger mechanism includes a trigger 23 that is pulled by the user, or shooter, in order to initiate the firing sequence of the firearm 10. Prior to firing, the trigger mechanism may hold a spring-loaded hammer (not shown) in a cocked position. The trigger mechanism may prevent the hammer from moving until the trigger 23 is pulled, and may release the hammer when the trigger 23 is pulled. Upon release, the hammer may strike a firing end of the cartridge 32, via a firing pin assembly, causing the primer within the cartridge 32 to ignite the propellant. Once ignited, the propellant forms a high-pressure propellant gas G that propels the projectile 30 through a lengthwise bore 17 formed in the barrel 16, until the projectile 30 exits the end, or muzzle 39 of the barrel 16 at high velocity. The projectile 30 may at least partially seal the bore 17 to cause the buildup of propellant gas G pressure behind the projectile for both driving the projectile and, once the projectile passes a barrel gas port in the barrel 16 associated with the gas system (e.g., the barrel gas port fluidically connected to the gas block 100 and/or the gas conduit 18), for driving the action 22.

The action 22 ejects the spent casing 31 from the firearm 10 after firing, reloads an unfired, or pre-firing, cartridge 32 into the chamber 33 from the magazine 19, and cocks the hammer of the trigger mechanism. The action 22 is gas-actuated, i.e., the action 22 may receive energy from the gas system (e.g., from a gas block 100 fluidically connected to the bore 17 via a barrel gas port and/or a gas conduit 18) in the form of at least a portion of the high-pressure propellant gas G generated by the burning propellant of the cartridges 32, and the energy may cause the action 22 to eject the spent casing 31, to reload an unfired cartridge 32, and cock the trigger mechanism.

The depicted gas system is a direct-impingement gas system in which the propellant gas G acts directly on the action 22. However, the technology disclosed herein can be used in connection with other types of gas systems, such as gas piston systems, including any gas system that directly or indirectly transfers energy of the propellant gas G from the bore 17 to drive the action 22. In such embodiments, the action may be said to include such pistons or other energy transfer mechanisms. Additionally, the depicted action 22 is a bolt carrier group, but other types of actions can be used in the alternative. The operation of such actions and other receiver components and trigger mechanisms in response to the inventive gas systems, methods, and assemblies disclosed herein would be understood by one of ordinary skill in the art in light of the present disclosure.

Figure 3:
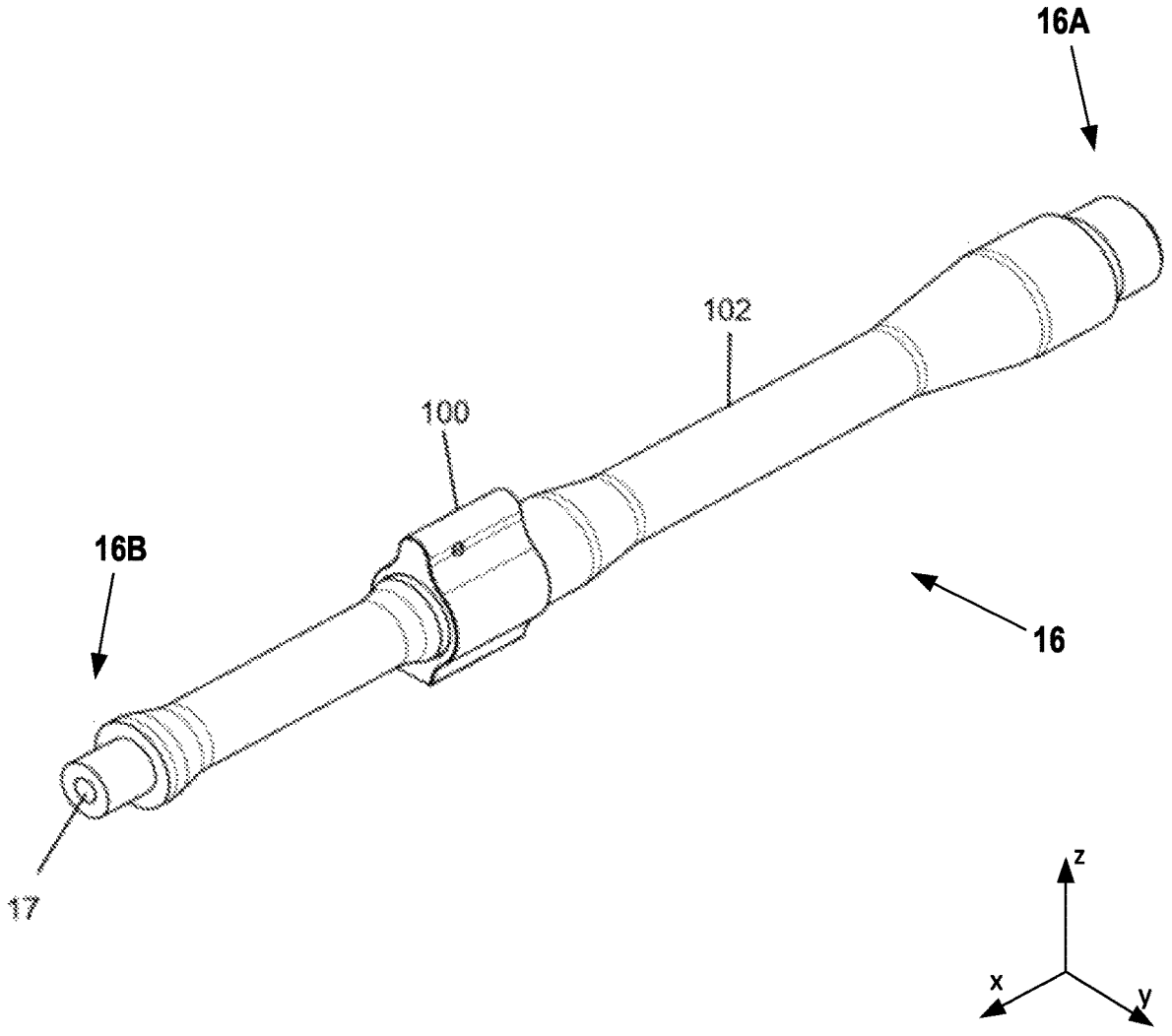
FIG. 3 is a front perspective view of an exemplary barrel of the firearm shown in FIGS. 1 and 2 with a gas block mounted thereon.

FIG. 3 illustrates a perspective view of an exemplary barrel 16 of a firearm according to various embodiments described herein. In various embodiments, a barrel 16 has an outer surface 102; and an inner surface 104 that defines the bore 17. A barrel 16 may be defined at least in part by a barrel length that is defined in a longitudinal direction (e.g., along a longitudinal axis defined in the x-direction, according to the orientation shown in FIG. 3). In various embodiments, the barrel length of an exemplary barrel 16 may be defined between an action-side end 16A of the barrel 16 a muzzle-side end 16B of the barrel 16. For example, the muzzle-side end 16B of the barrel 16 may be defined by a longitudinal end of the barrel 16 comprising a muzzle of the firearm and/or the longitudinal end arranged nearest the muzzle of the firearm (e.g., as defined along a longitudinal axis). Further, the action-side end 16A of the barrel 16 may be defined by an opposite longitudinal end of the barrel 16 relative to the muzzle-side end 16B. The action-side end 16A of the barrel 16 may be defined by the longitudinal end of the barrel 16 arranged nearest the action of the firearm (e.g., as defined along a longitudinal axis). As described herein, the bore 17 of the barrel 16 may extend lengthwise along a longitudinal axis defining a central axis of the barrel 16 and may be configured to guide a projectile along the barrel length of the barrel 16 as the projectile is propelled through the bore 17 by pressurized gas. For example, the barrel 16 may be configured such that a travel path of a projectile along the barrel length of the barrel 16 (e.g., within the bore 17) upon a firing of the firearm may include the projectile traveling from the action-side end 16A to the muzzle-side end 16B of the barrel 16.

As illustrated, a firearm comprising the exemplary barrel 16 may further comprise a gas block 100 engaged with the barrel 16 at a location along the barrel length thereof corresponding to a port exit of the barrel gas port, as described herein. For example, gas block 100 may be mounted on the barrel 16 (e.g., at the outer surface 102 via set screws or the like). In some embodiments, the gas port 100 is configured to fluidically connect the action of the firearm with the bore 17. For example, the gas port 100 is configured to fluidically connect the action of the firearm with the bore 17 by receiving a pressurized gas emitted from a port exit of a barrel gas port defined by the outer surface 102 of the barrel. In some embodiments, the gas block 100 and barrel 16 may be one integral piece made of a single block of material, separately formed components that are then attached (e.g., welded, screwed, adhered, or the like) during assembly, or any other manner of producing the described structures as a whole.

Figure 4A:
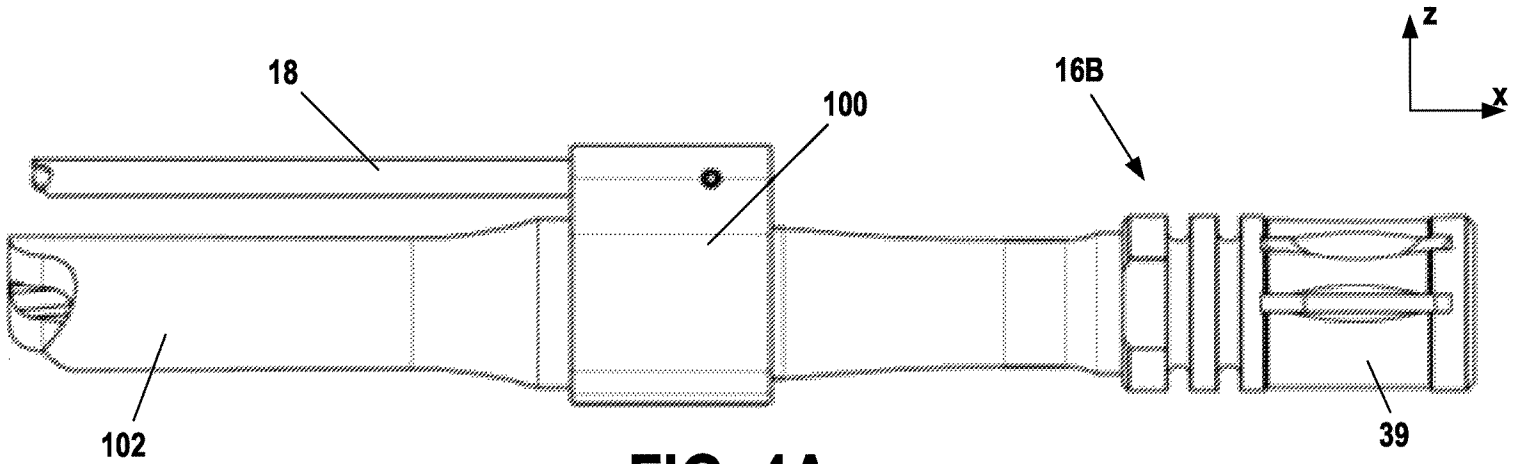
FIG. 4A is a side view of an exemplary barrel with a gas block mounted thereon according to various embodiments described herein.
Figure 4B:
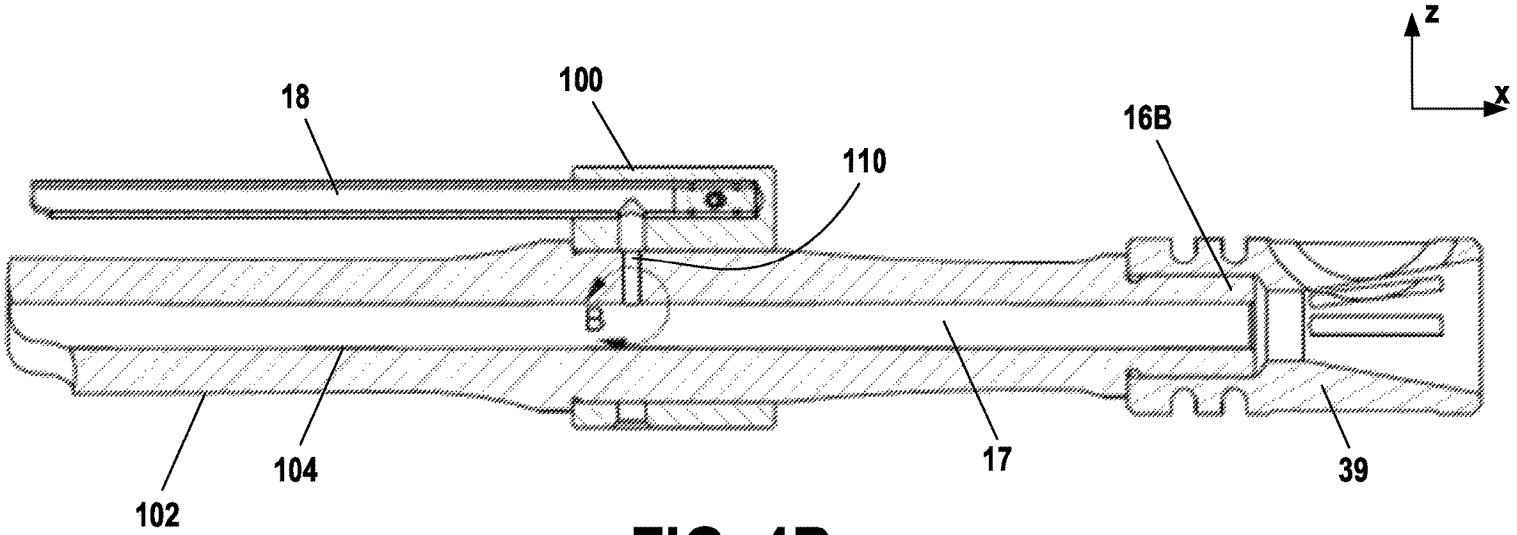
FIG. 4B is a cross-sectional side view of the exemplary barrel with a gas block mounted thereon shown in FIG. 4A.

As illustrated, in FIGS. 4A and 4B, the barrel 16 may be fluidically connected to an action of a firearm based on the configuration of the gas block 100, which may be mounted to a portion of the outer surface 102 defining the port exit of the barrel gas port 110 such that the gas block 100 may receive a volume of propellant gas (e.g., pressurized gas) emitted from the bore 17 via a port exit of the barrel gas port 110 and further guide the propellant gas to a gas conduit 18 configured to facilitate the flow of the propellant gas to the action of the firearm. The gas block 100 may be configured to fluidically connect the barrel gas port 110 to the gas conduit 18.

In various embodiments, the barrel 16 may comprise a barrel gas port 110 fluidly connected with the bore 17 of the barrel 16 and configured to form a flow path through which propellant gas may exit the bore 17. In some embodiments, the barrel gas port 110 extends through the barrel 16 between the inner surface 104 and the outer surface 102. The barrel gas port 110 comprises a gas port depth extending between a port entrance defined by the inner surface 104 of the barrel 16 and a port exit. For example, in some embodiments, the port exit of the barrel gas port 110 may be defined by the outer surface 102 of the barrel 16. In some embodiments, the barrel gas port 110 forms a flow path that extends in a direction substantially perpendicular to the lengthwise (longitudinal) direction of the bore 17. In some embodiments, the barrel gas port 110 may be configured to fluidically communicate with the bore 17 and an action of the firearm. For example, the barrel gas port 110 may be configured to enable a fluid communication between the bore 17 of the barrel 16 and the gas block 100 such that the propellant gas within the bore 17 may flow through the barrel gas port 110 to a gas conduit 18 (e.g., via the gas block 100) configured to guide the propellant gas to the action of the firearm. In some embodiments, multiple barrel gas ports may be used to connect the bore 17 to the gas conduit 18 via multiple entrances in the bore. In some embodiments, the multiple ports may combine from multiple entrances into the single gas conduit 18 within the barrel, between the barrel and the gas block, or within the gas block. Additional details about a firearm assembly having multiple gas ports are disclosed in U.S. application Ser. No. 17/450,319 filed Oct. 8, 2021 and titled "Firearm Assemblies with Multiple Gas Ports" which reference and its disclosures are hereby incorporated by reference herein.

Figure 5A:
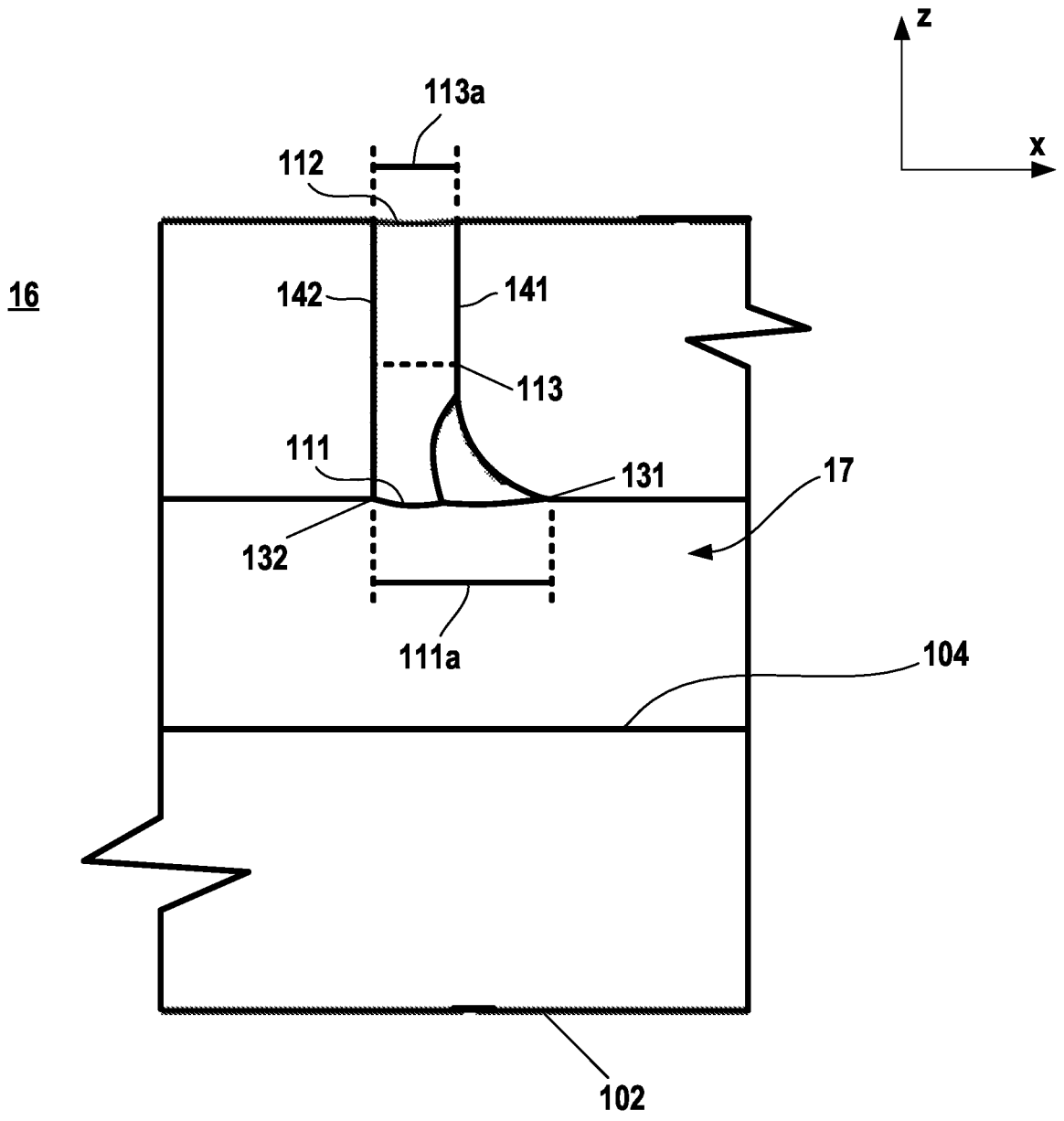
FIGS. 5A-5F illustrate various cross-sectional views of exemplary barrels having a barrel gas port according to various embodiments described herein.

FIGS. 5A-5F illustrate cross-sectional views of exemplary a barrel gas ports 110 extending through a barrel 16 from the bore to the outer surface according to various example embodiments of the present disclosure. As illustrated in FIG. 5A, the barrel gas port 110 may have a gas port depth extending between a port entrance 111 and a port exit 112. In some embodiments, the port entrance 111 is defined by the inner surface 104 of the bore 17 of the barrel 16. Further, in some embodiments, the port exit 112 is defined by the outer surface 102 of the barrel 16. In the depicted embodiment, an exemplary barrel gas port 110 extends through the barrel 16 between the bore 17 (e.g., at the port entrance 111) and the outer surface 102 (e.g., at the port exit 112) such that the barrel gas port 110 comprises a hollow channel having an outer boundary defined by the barrel 16. For example, the barrel gas port 110 may be defined by an inner wall having various contours from the port entrance 111 to the port exit. In various embodiments, the barrel gas port 110 may define one or more action-side wall surfaces comprising at least a portion of the inner wall surfaces arranged along a first longitudinal side of the barrel gas port 110 that is arranged closer to an action-side end of the barrel 16 than the opposing longitudinal side. Further, the barrel gas port 110 may be defined by an inner wall having one or more muzzle-side wall surfaces arranged closer to a muzzle-side end of the barrel 16 and defining at least a portion of the inner wall surfaces arranged along a second longitudinal side opposite the one or more action-side wall surfaces.

Figure 5B:
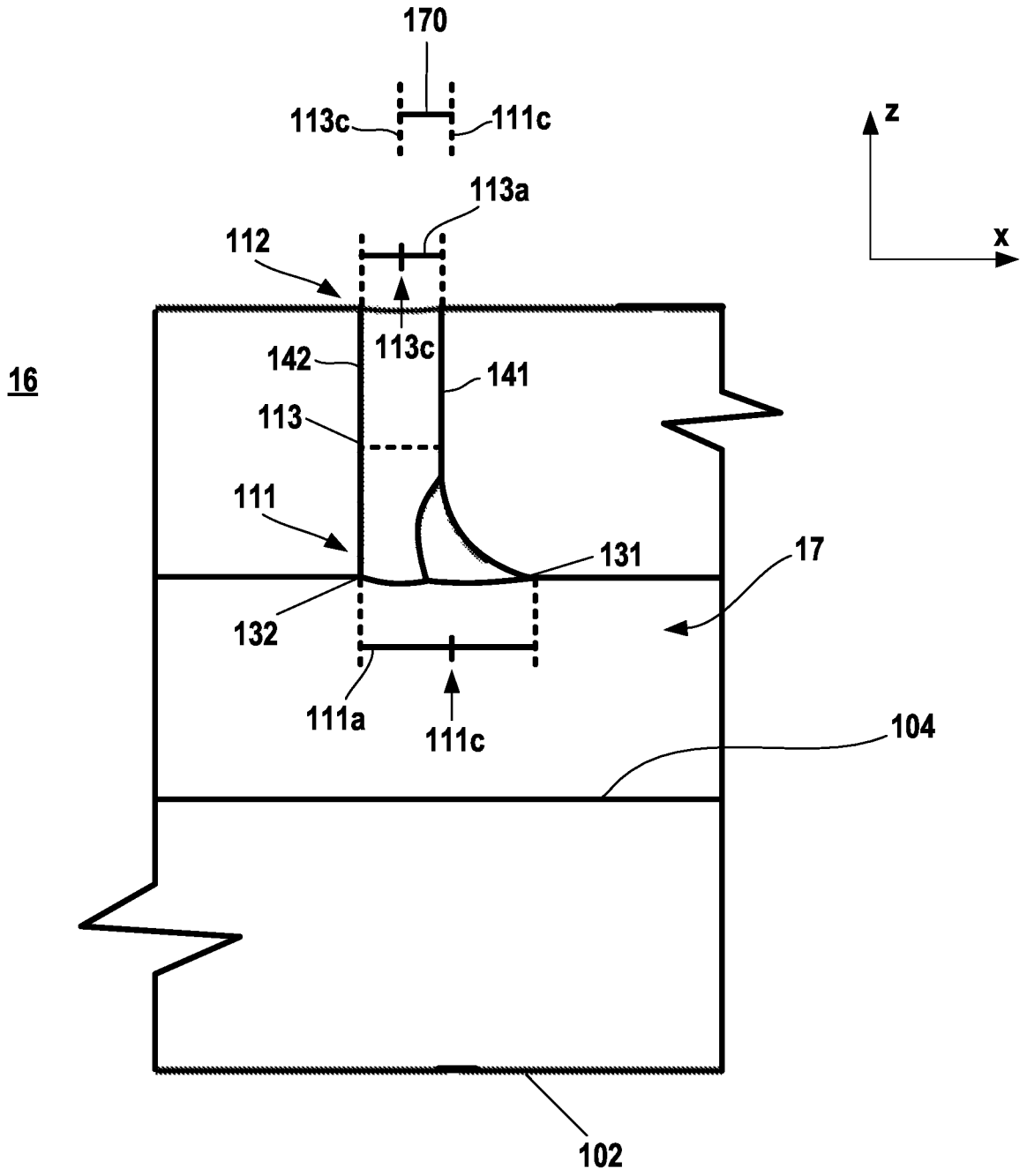
Figure 5C:
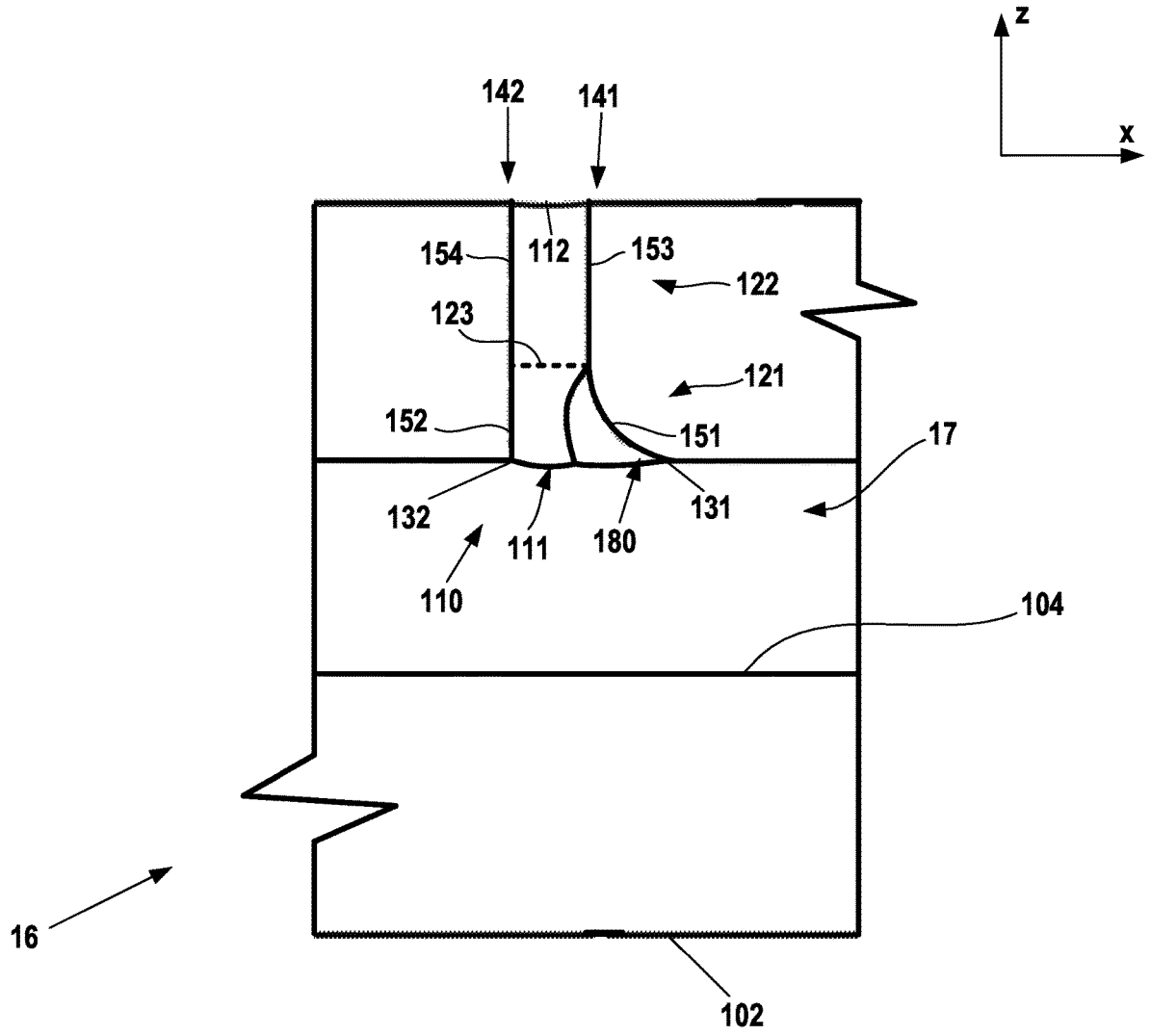

As illustrated in the exemplary barrel 16 shown in FIG. 5C, for example, an exemplary barrel gas port 110 may be defined by an inner wall having one or more action-side wall surfaces 142 defining at least a portion of the inner wall surfaces arranged along the longitudinal side of the barrel gas port 110 that is arranged closer to the action-side end of the barrel 16; and one or more muzzle-side wall surfaces 141 defining an opposing longitudinal portion defined along the longitudinal side of the barrel gas port 110 that is arranged closer to the muzzle-side end of the barrel 16.

Further, the port entrance 111 may be defined by an action-side edge 132 and a muzzle-side edge 131 defined by the inner surface 104 at a first longitudinal end and an opposing second longitudinal end of the port entrance 111, respectively. For example, the action-side edge 132 may define at least a portion of the perimeter edge defining the port entrance 111 that is arranged closer to the action-side end of the barrel 16 than the muzzle-side of the barrel 16. Similarly, the muzzle-side edge 131 may define at least a portion of the perimeter edge defining the port entrance 111 that is arranged closer to the muzzle-side end of the barrel 16 than the action-side of the barrel 16. In various embodiments, the action-side edge 132 and the muzzle-side edge 131 of the port entrance 111 may be defined such that as a projectile is propelled by a propellant gas in a discharge direction along the longitudinal axis of the bore 17 from an action-side end of the barrel 16 towards the muzzle-side end of the barrel 16, the projectile travels through an axial portion of the barrel length that is adjacent the action-side edge 132 before travelling through a second axial portion of the barrel length adjacent the muzzle-side edge 131. In such an exemplary circumstance, the muzzle-side edge 131 of the port entrance 111 may be downstream from the action-side edge 132 as defined relative to the travel path of a projectile within the barrel 16 (e.g., in the discharge direction).

As illustrated, the barrel gas port 110 may be defined by a cross-sectional area that varies at one or more locations along the gas port depth of the barrel gas port 110 (e.g., perpendicular to the length of the barrel) to reduce impingement of the projectile on the barrel gas port and the surrounding surface of the barrel. In some embodiments, the port entrance of the barrel gas port may be elongated in the direction of the muzzle with a shallower angle on the inner surface of the barrel gas port on the muzzle-side to reduce such impingement of the projectile and damage to the barrel. In various embodiments, a cross-sectional area at a location defined along the gas port depth of the barrel gas port 110 may be defined at least in part by a length dimension defined parallel to a longitudinal axis of the barrel 16 and a width dimension defined perpendicular to the length dimension and perpendicular to the depth of the barrel gas port. For example, a length dimension may be defined by a longitudinal distance between an action-side surface, edge, and/or point of the inner wall the barrel gas port 110 at a location along the depth (e.g., between the bore and outer surface) of the barrel gas port and a muzzle-side surface, edge, and/or point of the inner wall of the barrel gas port 110 at the same location along the depth dimension, as measured in a direction parallel to the longitudinal axis of the barrel 16. Further, a width dimension may be defined by a perpendicular distance measured in a direction perpendicular to the length dimension between opposing side surfaces, edges, and/or points of the wall of the barrel gas port 110 defined on respective sides of the length dimension at a same location along the depth of the barrel gas port.

Figure 6:
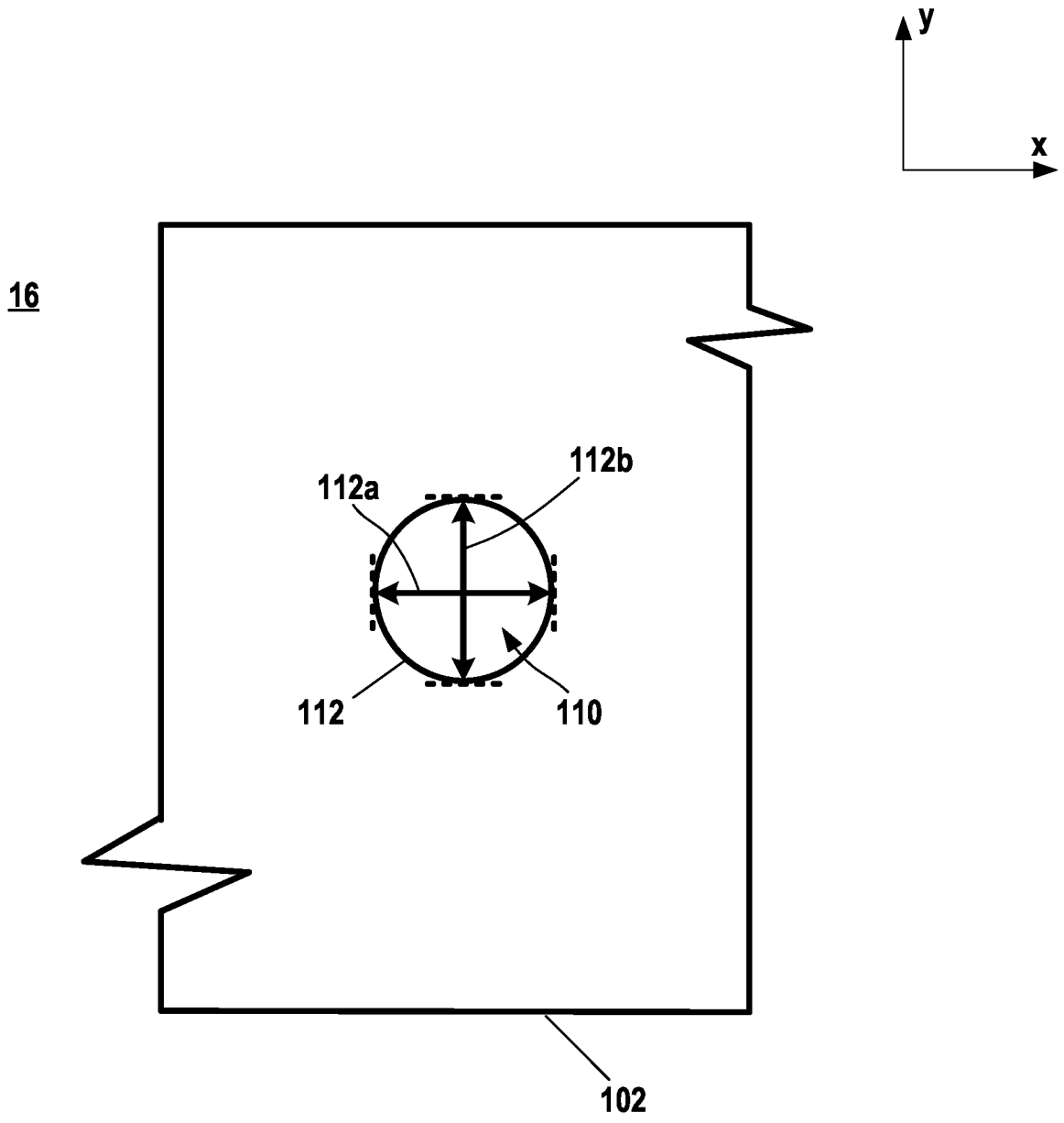
FIG. 6 illustrates a partial top view of an exemplary barrel having a barrel gas port according to various embodiments described herein.

For example, FIG. 6 illustrates a top view of an exemplary barrel 16 comprising a barrel gas port 110 with a port exit 112 defined by the outer surface 102 of the barrel 16. As shown, the port exit 112 may comprise an opening configured to receive pressurized gas therethrough from the barrel gas port 110 in order to facilitate a flow of pressurized gas from the barrel gas port 110 to an action of the firearm. For example, the port exit 112 may comprise a curved surface (e.g., opening) of the barrel gas port 110 that is defined by the outer surface 102 and embodies a gas outlet of the barrel gas port 110. As illustrated, the port exit 112 defines a length dimension 112*a* defined parallel to a longitudinal axis of the barrel 16 (e.g., in an x-direction, according to the exemplary orientation illustrated in FIG. 6) and a width dimension 112*b* defined perpendicular to the length dimension (e.g., in a y-direction, according to the exemplary orientation illustrated in FIG. 6). In the depicted embodiment, the port exit 112 is a circular shape when viewed in planar cross-section (e.g., as would be formed by a cylindrical drill or mill bit protruding through the curved surface of the barrel). For example, the port exit 112 may be defined by a port exit area that is defined at least in part by the length dimension and the width dimension thereof.

Returning to the exemplary embodiments illustrated in FIGS. 5A-5F, a port entrance 111 of an exemplary barrel gas port 110 may comprise an opening configured to receive pressurized gas therethrough from the bore 17 in order to facilitate a flow of pressurized gas from the bore 17 into the barrel gas port 110 and subsequently to the action of the firearm. For example, the port entrance 111 may comprise an opening of the bore 17 that is defined by the inner surface 104 and embodies a gas inlet of the barrel gas port 110. The port entrance 111 may define a length dimension defined parallel to the longitudinal axis of the barrel 16 (e.g., the axis x shown in FIG. 2) and a width dimension defined perpendicular to the length dimension (e.g., the y axis shown in FIG. 2). For example, the length dimension 111*a* of the port entrance 111 may be defined by a longitudinal distance (e.g., a distance measured in a longitudinal direction parallel to the longitudinal axis defined by the bore 17) between an action-side edge 132 and a muzzle-side edge 131 of the port entrance 111. In various embodiments, the length dimension of the port entrance 111 may be greater than the width dimension of the port entrance 111. It should be understood that the description of the length dimension of the port entrance 111 provided herein should not be interpreted as limiting with respect to the number and/or types of shapes of entrance that may be operably utilized within an exemplary barrel 16. Rather, the disclosure of the length dimension of the port entrance 111 provided herein is provided in order to describe the length of the port entrance 111 as measured along a single axis in a particularly specified direction, such as, for example, in a direction parallel to the longitudinal axis of the barrel 16. In various embodiments, the port entrance 111 may be an oblong or oval shape.

In various embodiments, the barrel gas port 110 may narrow in the depth direction from the port entrance 111. In some embodiments, the port entrance may be the largest portion of the barrel gas port 110 (e.g., as measured by cross sectional area and/or individual length and/or width dimensions). For example, in various embodiments, the length dimension of the port entrance 111 may be greater than a second length dimension of the barrel gas port 110 defined parallel to the longitudinal axis and vertically offset in the depth direction (e.g., the z axis shown in FIG. 2) to a location between the port entrance 111 and the port exit 112. For example, as illustrated in FIG. 5A, the length dimension 111*a* of the port entrance 111 may be greater than a second length dimension 113*a* of the barrel gas port 110 defined parallel to the longitudinal axis at an intermediate location 113 (e.g., a port depth) defined between the port entrance 111 and the port exit 112. An intermediate location 113 within the barrel gas port 110 may comprise a location defined within the barrel gas port 110 at a port depth (e.g., defined in a direction perpendicular to the longitudinal axis of the bore 17, such as, for example, in the z-direction according to the orientation illustrated in FIG. 5A) corresponding to a location between the port entrance 111 and the port exit 112 that is defined within a plane having a parallel configuration relative to the longitudinal axis of the bore 17. For example, a second length dimension 113*a* of the intermediate location 113 may be defined by a longitudinal distance between respective portions of the action-side wall surface 142 and the muzzle-side wall surface 141 defined at the intermediate location 113 at the port depth. In the depicted embodiment, the intermediate location 113 is shown at a position where the second length dimension 113*a* has assumed a constant value after tapering in a transition region from the port entrance 111. In some embodiments, the constant value of the second length dimension 113*a* may be maintained from the end of the transition region to the outer surface of the barrel. In some embodiments, the depicted intermediate location 113 may be the narrowest location parallel to the longitudinal axis along the length of the barrel gas port. As a non-limiting example, in various embodiments in which the intermediate location is a narrowest location and/or a location at which the wall of the barrel gas port is cylindrical, a length dimension 111*a* of the port entrance 111 may be at least approximately between 1.1 times and 5.0 times greater than the second length dimension 113*a* defined at the intermediate location 113 within the barrel gas port 110. For example, in various embodiments, the length dimension 111*a* of the port entrance 111 may be at least approximately 1.125 times greater than the second length dimension 113*a*, 1.250 times greater than the second length dimension 113*a*, 2.5 times greater than the second length dimension 113*a*, three times greater than the second length dimension 113*a*, four times greater than the second length dimension 113*a*, between two times and three times greater than the second length dimension 113*a*, between three times and four times greater than the second length dimension 113*a*, and/or between two times and four times greater than the second length dimension 113*a*, and/or any subrange or sub-combination thereof.

In various embodiments in which the intermediate location is a narrowest location and/or a location at which the wall of the barrel gas port is cylindrical, the length dimension 111*a* of the port entrance 111 may be at least approximately between 0.025 inches and 0.300 inches (e.g., between 0.045 inches and 0.250 inches), while the length dimension 112*a* of the port exit 112 may be at least approximately between 0.020 inches and 0.125 inches (e.g., between 0.040 inches and 0.100 inches). In various embodiments, the dimensional configuration of the exemplary barrel gas port 110 (e.g., the length dimension 111*a* of the port entrance 111, the length dimension 112*a* of the port exit 112) may be configured based at least in part on the barrel length of the barrel 16, the size of the charge and power of the round, and/or the configuration of the projectile to be fired along the barrel. Further, in various embodiments, an exemplary barrel gas port 110 may comprise a transition region 121 that is configured such that the length dimension 111*a* of the port entrance 111 is at least approximately between 0.005 inches and 0.150 inches (e.g., between 0.010 inches and 0.100 inches) longer than the length dimension 112*a* (e.g., the diameter) of the port exit 112 and/or the second length dimension 113*a* defined at the intermediate location 113 within the barrel gas port 110. In various embodiments, the length dimension 111*a* may be determined as the minimum length dimension required to actuate the firearm without the projectile physically damaging itself or the port entrance 111.

In various embodiments, the length dimension 111*a* of the port entrance 111 may comprise a center point (e.g., point 111*c* shown in FIG. 5B) defined by a halfway point along the longitudinal distance between the action-side edge 132 and the muzzle-side edge 131 that defines the length dimension 111*a*. Further, the second length dimension 113*a* of the intermediate location 113 may comprise a second center point (e.g., point 113*c* shown in FIG. 5B) defined by a halfway point along the second longitudinal distance defined between the respective portions of the action-side wall surface 142 and the muzzle-side wall surface 141 defined at the intermediate location 113. For example, in various embodiments, a center point of the length dimension 111*a* of the port entrance 111 may be located closer to a muzzle-side end of the barrel 16 than a second center point of the second length dimension of the barrel gas port 110 at the intermediate location 113, which may indicate that the barrel gas port opens up more towards the muzzle end at the port entrance. For example, with reference to FIG. 5B, in such an exemplary circumstance, the center point 111*c* of the length dimension 111*a* and the second center point 113*c* of the second length dimension 113*a* may define respective longitudinal positions along the length of the barrel 16 that are separated by a longitudinal distance parallel to the longitudinal axis defined by the bore 17. In some embodiments, this relationship may be true for any intermediate location between the port entrance 111 and the port exit 112. As illustrated in FIG. 5B, for example, a center point of the length dimension 111*a* of the port entrance 111 is illustratively represented by element 111*c* defined by a first longitudinal position along the length of the barrel 16; and a second center point of the second length dimension 113*a* is illustratively represented by a second center point element 113*c* defined by a second longitudinal position along the length of the barrel 16. As illustrated, the center point element 111*c* of the length dimension 111*a* of the port entrance 111 and the second center point element 113*c* of the second length dimension 113*a* at the intermediate location 113 of the barrel gas port 110 may be separated by a longitudinal separation distance 170. The center point element 111*c* of the length dimension 111*a* may be located closer to a muzzle-side end of the barrel 16 than the second center point element 113*c* by a distance corresponding to the longitudinal separation distance 170 defined therebetween. Further, in various embodiments, the center point 11*c* of the length dimension 111*a* of the port entrance 111 may be located closer to a muzzle-side end of the barrel 16 than a third center point of a third length dimension of the barrel gas port 110 at a location defining the narrowest portion of the transition region, such as, for example, at a flow region inlet location 123 illustrated in FIG. 5C. Further, in various embodiments, the center point 111*c* of the length dimension 111*a* of the port entrance 111 may be located closer to a muzzle-side end of the barrel 16 than a fourth center point of a fourth length dimension of the barrel gas port 110 at a location defined by a port depth within the transition region 121 (labeled in FIG. 5C) of the barrel gas port 110 in between the port entrance 111 and a flow region 122 (labeled in FIG. 5C), as described herein.

Figure 5D:
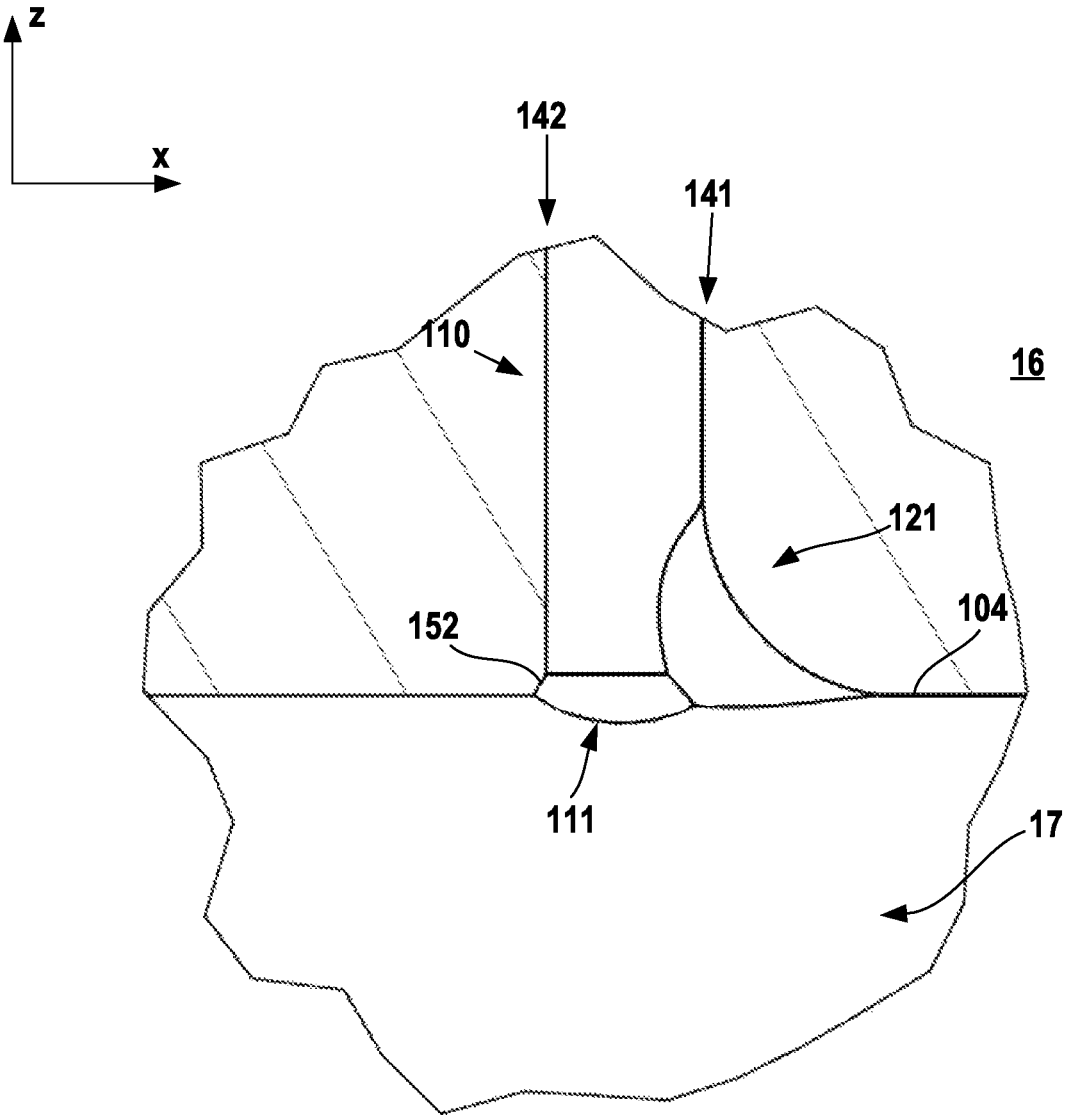

In some embodiments, the width of the barrel gas port 110 may be constant from the port entrance 111 to the port exit 112. In some embodiments, the width of the barrel gas port 110 may decrease by a lesser amount than the length of the barrel gas port from the port entrance 111 to the port exit 112. For example, in various embodiments, the width dimension of the port entrance 111 may be equal to a second width dimension of the barrel gas port 110 defined at a location (e.g., a port depth) of the second length dimension. For example, with respect to the exemplary embodiment illustrated in FIG. 5A, the width dimension of the port entrance 111 may be equal to a second width dimension of the barrel gas port 110 at the intermediate location 113 of the second length dimension 113*a*. Further, in some embodiments, the port entrance area defined by the port entrance 111 may be greater than a second area defined at a location of the second length dimension based at least in part on the length dimension of the port entrance being greater than the second length dimension. For example, in such an exemplary configuration wherein the width dimension of the port entrance 111 is equal to the second width dimension of the barrel gas port 110 at the intermediate location 113, the difference between the port entrance area defined by the port entrance 111 and the second area defined at the intermediate location 113 may be based at least in part on the length dimension 111*a* of the port entrance 111 being greater than the second length dimension 113*a* of the intermediate location 113. In some embodiments, a narrower width dimension, including a constant width as described herein, may reduce the surface area of the projectile that is exposed to the barrel gas port and reduce the impingement of the projectile on the port surfaces. Alternatively, or additionally, in various embodiments, the width dimension of the port entrance 111 may be greater than a second width dimension of the barrel gas port 110 at the intermediate location 113 of the second length dimension 113*a*, such as is depicted in FIG. 5D.

As illustrated in FIG. 5C, in various embodiments, an exemplary barrel gas port 110 may define a flow region 122 defining a constant cross-sectional area for at least a first portion of the gas port depth; and a transition region 121 defined along a second portion of the gas port depth between the port entrance 111 and the flow region 122. The flow region 122 of the barrel gas port 110 may be configured to guide pressurized gas within the barrel gas port 110 along a corresponding portion of the gas port depth to the port exit 112. For example, the port exit 112 may embody an outlet of the flow region 122. In various embodiments, the flow region 122 may comprise a cylindrical shape having a constant diameter throughout, such as may be created by a drill bit or mill bit plunging in the z-axis shown in FIG. 2. The diameter of the flow region 122 may be equal to the length dimension of the barrel gas port 110 as defined at each port depth defined within the flow region 122, such that the diameter of the flow region is less than the length dimension of the port entrance 111. For example, in various embodiments, the flow region 122 may have a diameter of at or about 0.089 inches. As used herein, the term "about" in reference to a numerical value means plus or minus 15 percent of the numerical value of the number with which it is being used. Also, specific dimensions are presented herein for exemplary purposes only, and unless expressly stated otherwise are not intended to limit the scope of the appended claims; alternative embodiments can have dimensions other than those specified herein.

Further, the transition region 121 of the barrel gas port 110 may be defined by a second portion of the gas port depth of the barrel gas port 110 between the port entrance 111 and the flow region 122. The transition region 121 may be configured to receive pressurized gas from the bore 17 via the port entrance 111. For example, the port entrance 111 may embody an inlet of the transition region 121. In various embodiments, the transition region 121 may be positioned directly downstream from the port entrance 111 relative to the pressurized gas flow path defined into the barrel gas port 110. As illustrated, the transition region 121 may define a cross-sectional area that varies at one or more depths along the portion of the gas port depth corresponding thereto. For example, a first cross-sectional area of the transition region 121 defined at a first location within the transition region 121 may be different than a second cross-sectional area of the transition region 121 defined at a second location therein. As a further example, in some embodiments, a port entrance area may be different (e.g., greater) than a second cross-sectional area of the transition region 121 defined at a second depth between the port entrance 111 and the flow region 122. In some embodiments, within the transition region 121, the longitudinal length of the port may vary relative to the depth dimension such that the longitudinal center point (e.g., relative to the x axis in FIG. 2) at any depth location (e.g., as measured relative to the z axis in FIG. 2) within the transition region may be closer to the muzzle-side end 16B than every position above it (e.g., closer to the port exit 112) and may be farther from the muzzle-side end 16B than every position below it (e.g., closer to the port entrance 111) to reflect the tapered structure of the barrel gas port in the transition region.

In various embodiments, an exemplary barrel gas port 110 may be defined by an inner wall having one or more action-side wall surfaces 142 and one or more muzzle-side wall surfaces 141. As illustrated, in some embodiments, the one or more muzzle-side wall surfaces 141 may be defined by a flow region muzzle-side wall surface 153 and a transition region muzzle-side wall surface 151; and the one or more action-side wall surfaces 142 may be defined by a flow region action-side wall surface 154 and a transition region action-side wall surface 152. For example, the transition region muzzle-side wall surface 151 may comprise a three-dimensional surface defined by the interior surface of the barrel gas port 110 between the muzzle-side edge 131 and the flow region 122 (e.g., the flow region muzzle-side wall surface 153). In various embodiments, the transition region 121 may comprise comprises a larger surface area within the barrel gas port 110 on a muzzle side of the barrel gas port 110 than on an action side of the barrel gas port 110. For example, in various embodiments, a surface are of the transition region muzzle-side wall surface 151 may be greater than a second surface area of the transition region action-side wall surface 152. Further, in various embodiments, the transition region 121 defines a surface angle 180 at a location between the port entrance 111 and the flow region 122. For example, the surface angle 180 may be between an angle of the bore 17 and an angle of a wall surface of the barrel gas port 110 in the transition region 121. For example, in various embodiments, the transition region 121 may define a surface angle 180, an angle of the bore 17 (e.g., the horizontal in the longitudinal direction), and an angle of the flow region muzzle-side wall surface 153 (e.g., vertical in the depth direction). In various embodiments, the surface angle 180 may be defined at least in part by the transition region muzzle-side wall surface 151. Further, in various embodiments, the transition region muzzle-side wall surface 151 may be defined by a complex curvature defined by a first radius of curvature defined in a first plane (e.g., the x-z plane of FIG. 2) and a second radius of curvature defined in a second plane (e.g., the y-z plane of FIG. 2). In some embodiments, the barrel gas port 110 may define a cylindrical shape apart from the transition region muzzle-side wall surface 151 which may be shaped by the additional removal of material during manufacturing.

In various embodiments, the transition region 122 may be configured such that the transition region muzzle-side wall surface 151 is defined by a non-cylindrical surface having a shape that defines a depth that extends further into the barrel gas port 110 (e.g., as defined from the port entrance 111) than a non-cylindrical portion of the transition region action-side wall surface 152. For example, in various embodiments, the transition region action-side wall surface 152 may comprise a cylindrical shape identical to the cylindrical shape of the flow region muzzle-side wall surface 153 adjacent thereto throughout the entirety of the transition region 122. As illustrated, the muzzle-side depth defined by the non-cylindrical shape of the transition region muzzle-side wall surface 151 may define a flow region inlet location 123 embodying an intermediate location, as defined herein, comprising a two-dimensional surface (e.g., opening) defined within the barrel gas port 110 at which the flow region 122 begins. In some embodiments, the transition region muzzle-side wall surface 151 may define a partially cylindrical or a partially portion formed by a cutting head oriented oblique to the depth axis (e.g., oblique to the z-axis of FIG. 2). In some embodiments, the transition region of the muzzle-side wall surface 151 may define a partially curved tubular shape (e.g., a partially curved tubular shape intersecting the straight cylindrical shape of the remainder of the barrel gas port) consistent with a cylindrical cutting head turning from parallel or approximately parallel to the longitudinal axis as the cut starts and ending parallel or approximately parallel to the depth axis as the cut finishes.

In various embodiments, at least a portion of the transition region action-side wall surface 152 may be defined by a non-cylindrical surface having a chamfer shape or rounded shape that defines an action-side depth extending into the barrel gas port 110 (e.g., as defined from the port entrance 111). For example, the exemplary barrel 16 illustrated in FIG. 5D includes a transition region action-side wall surface 152 defining a chamfer or rounded shape that is defined along a portion of the gas port depth within the transition region 121. For example, as illustrated, in various embodiments, the transition region muzzle-side wall surface 151 may be defined by a non-cylindrical shape that is defined at a portion of the transition region muzzle-side wall surface 151. In such an exemplary circumstance, the transition region action-side wall surface 152 and at least substantially a remaining portion of the transition region muzzle-side wall surface 151 not defined within the aforementioned non-cylindrical shape may comprise a chamfer or rounded shape. In various embodiments, the action-side depth defined by the chamfer or rounded shape of the non-cylindrical portion of the transition region action-side wall surface 152 may be less than a muzzle-side depth defined by the non-cylindrical shape of the transition region muzzle-side wall surface 151.

Figure 5E:
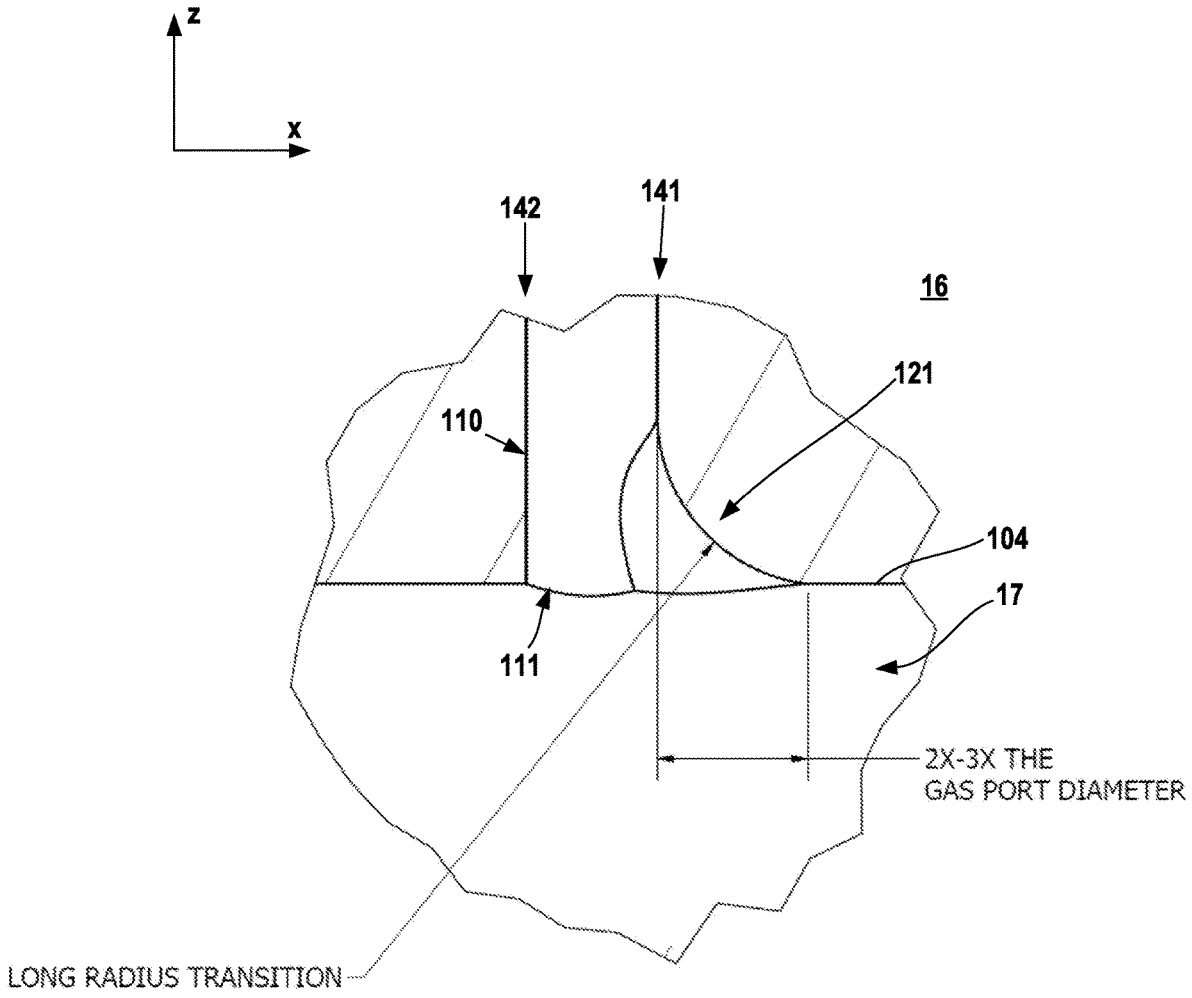
Figure 5F:
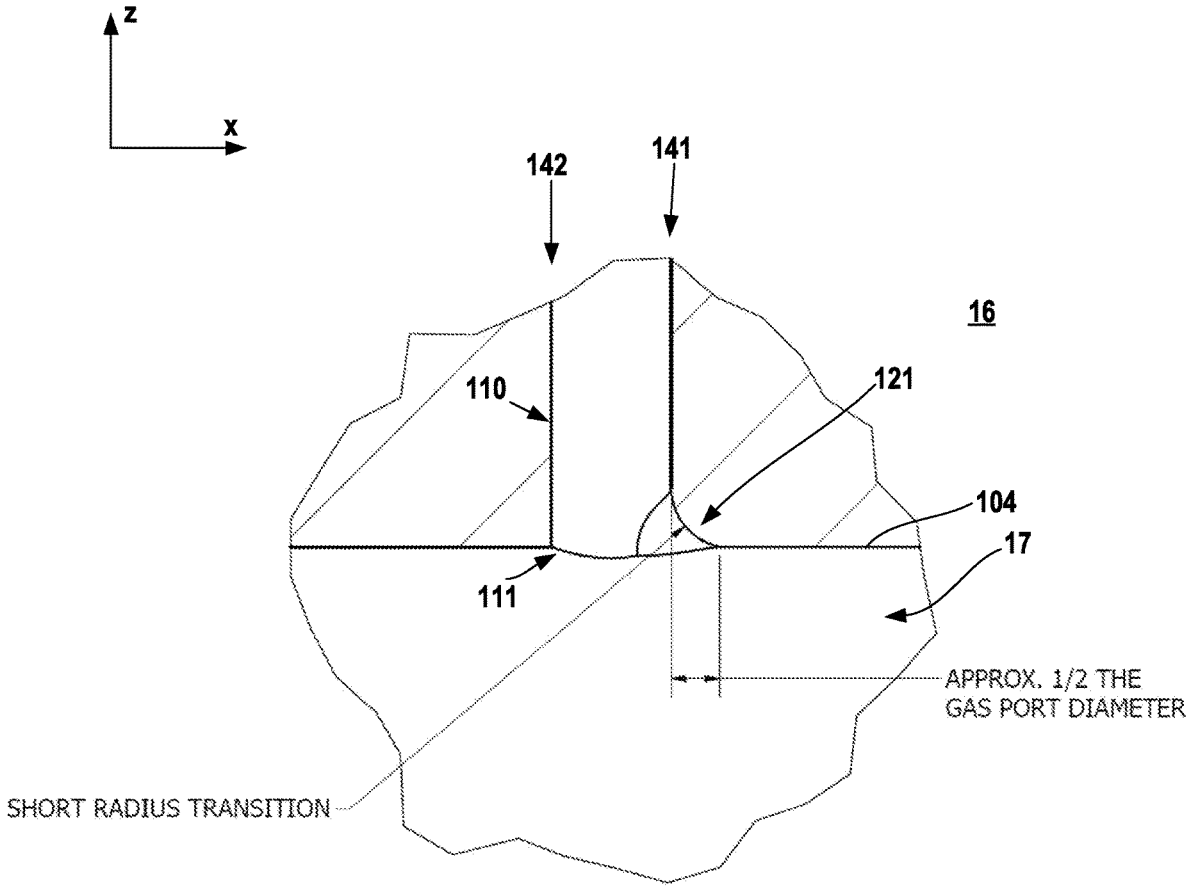

With reference to FIGS. 5E-5F, embodiments of the barrel gas port 110 are shown having different longitudinal lengths (e.g., in the x-direction). FIG. 5E depicts a transition region 121 of the barrel gas port 110 having a length at the port entrance 111 that is two to three times the diameter of the gas port in the cylindrical portions (e.g., the flow region). The depicted barrel gas port 110 then also includes a long radius transition such that the transition region extends farther in the depth direction than the embodiment of FIG. 5F, which has a shorter length of the port entrance. FIG. 5F depicts a transition region 121 of the barrel gas port 110 having a length at the port entrance 111 that is approximately one half the diameter of the gas port in the cylindrical portions (e.g., the flow region).

Figure 5I:
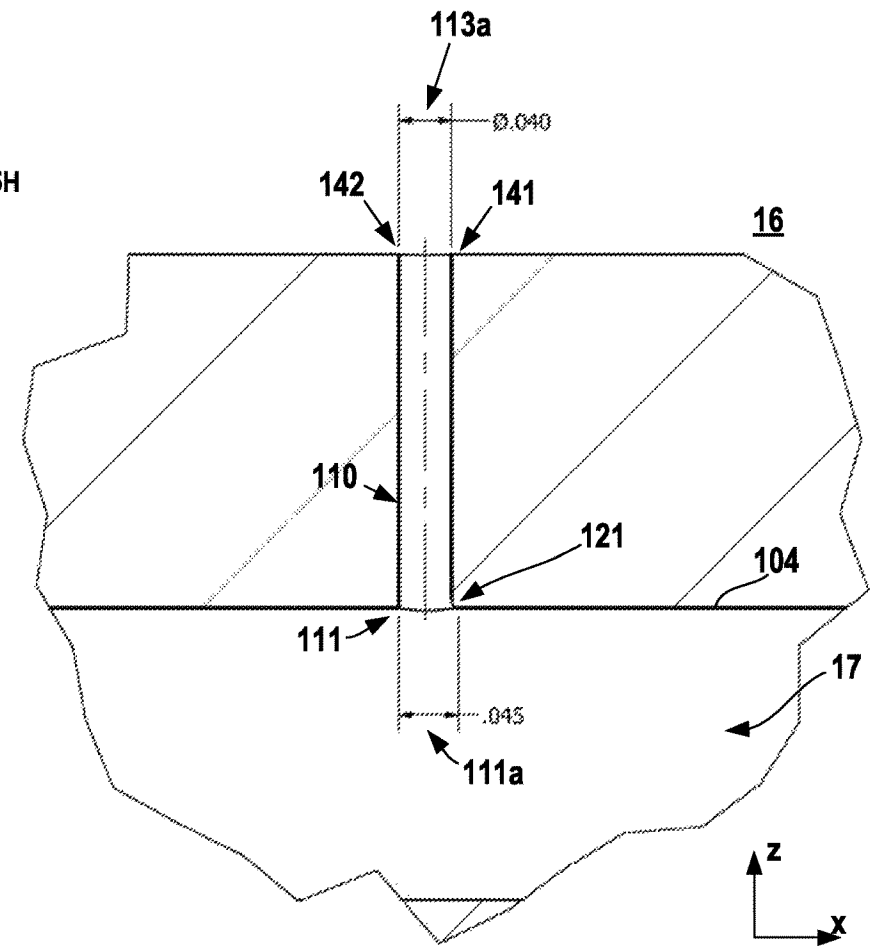
FIG. 5I is a detail view of the cross-section of FIG. 5H shown in detail circle "5I"
Figure 5G:
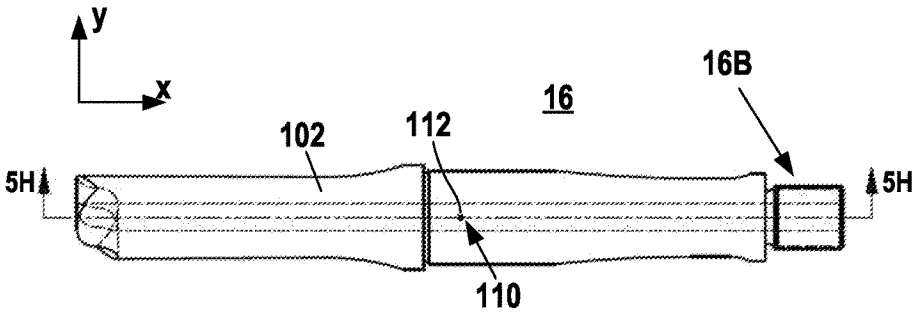
FIG. 5G is a front perspective view of an exemplary barrel having a barrel gas port according to various embodiments described herein.
Figure 5H:
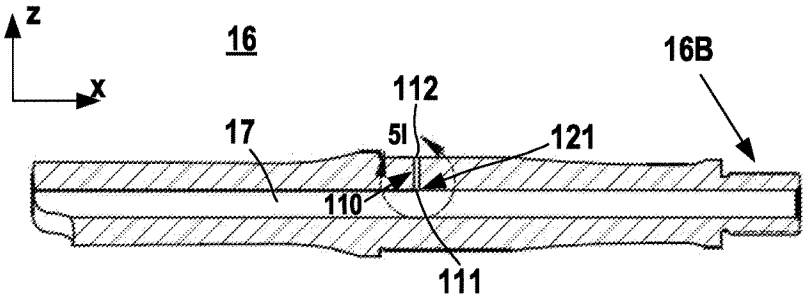
FIG. 5H is a cross-section view of the barrel of FIG. 5G taken along section line "5H-5H"

With reference to FIGS. 5G-5I, and FIGS. 5J-5L, embodiments of exemplary barrels comprising barrel gas ports 110 are shown having different dimensional configurations. FIG. 5G illustrates a top view of an exemplary barrel 16 including the port exit 112 of a barrel gas port 110 defined by the outer surface 102 of the barrel 16, while FIG. 5H illustrates a side-cross-sectional view of the barrel 16 taken along section line 5H-5H of FIG. 5G. FIG. 5I illustrates the detail section view of circle 5I of FIG. 5H. As shown in FIG. 5I, the barrel gas port 110 includes a length dimension 111*a* of the port entrance 111 that is at least approximately 0.045 inches. The embodiment shown in FIG. 5I further includes a second length dimension 113*a* that comprises a diameter of the cylindrical portion (e.g., the flow region) the barrel gas port 110 and is at least approximately 0.040 inches.

Figure 5L:
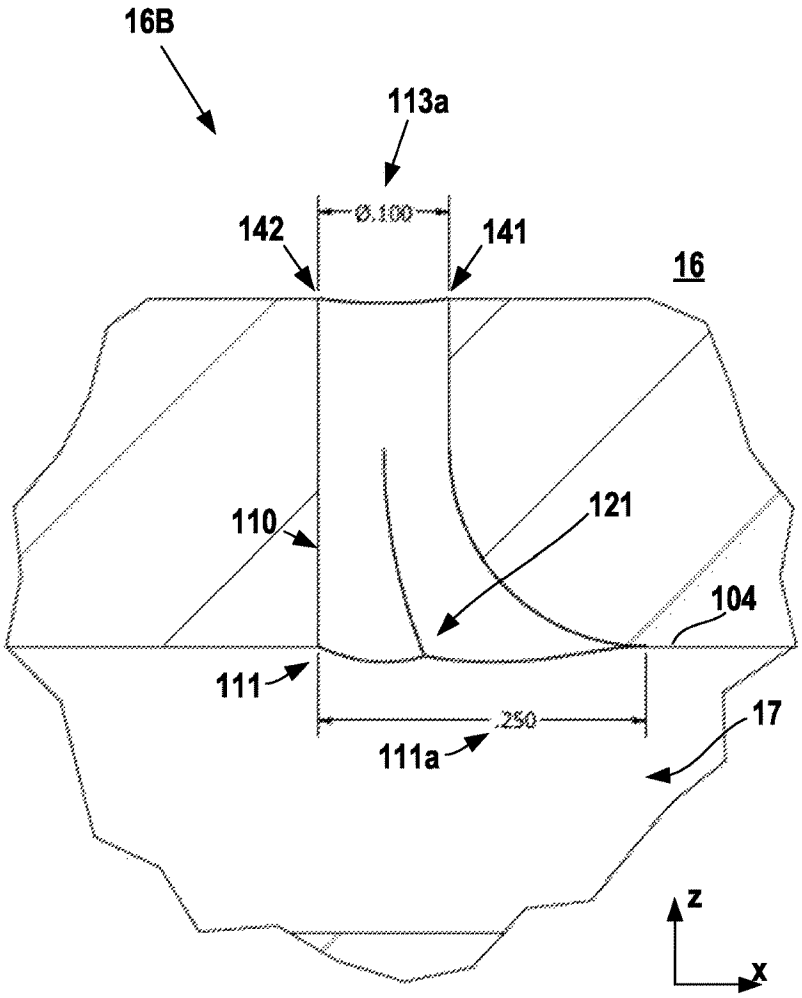
FIG. 5L is a detail view of the cross-section of FIG. 5K shown in detail circle "5L"
Figure 5J:
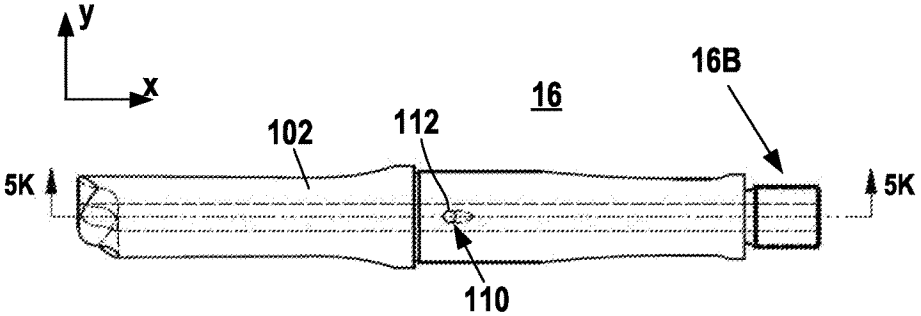
FIG. 5J is a front perspective view of an exemplary barrel having a barrel gas port according to various embodiments described herein.
Figure 5K:
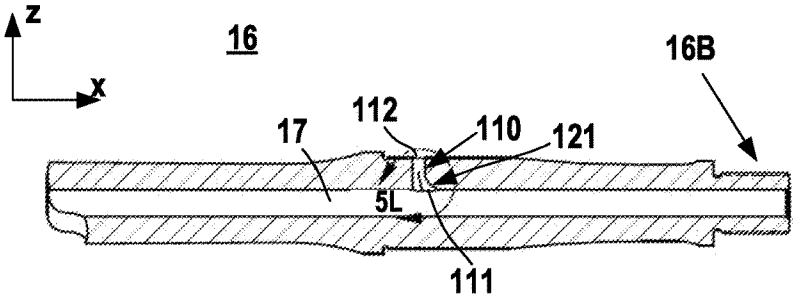
FIG. 5K is a cross-section view of the barrel of FIG. 5J taken along section line "5K-5K"

FIG. 5J illustrates a top view of an exemplary barrel 16 including the port exit 112 of a barrel gas port 110 defined by the outer surface 102 of the barrel 16, while FIG. 5K illustrates a side-cross-sectional view of the barrel 16 taken along section line 5K-5K of FIG. 5J. FIG. 5L illustrates the detail section view of circle 5L of FIG. 5K. As shown in FIG. 5L, the barrel gas port 110 includes a length dimension 111*a* of the port entrance 111 that is at least approximately 0.250 inches. The embodiment shown in FIG. 5L further includes a second length dimension 113*a* that comprises a diameter of the cylindrical portion (e.g., the flow region) the barrel gas port 110 and is at least approximately 0.100 inches. The barrel gas port 110 depicted in FIG. 5L then includes a transition region 121 that extends farther in the depth direction than the embodiment of FIG. 5I, which has a shorter length dimension 111*a* of the port entrance 111.

In various embodiments, an exemplary barrel 16 may comprise a plurality of barrel gas ports, including the barrel gas port 110, in fluid communication with the bore 17. In such embodiments, one or more of the barrel gas ports may be structured in accordance with any of the embodiments disclosed herein. In some such configurations, each of the plurality of barrel gas ports defined in the barrel 16 may be fluidically combined into a single passage or conduit of the gas system (e.g., a gas block) at or before the action, including but not limited to within the barrel, at the transition between the barrel and gas block, and/or within the gas block. The barrel gas ports may be simultaneously fluidically coupled with at least a portion of the action to allow pressurized gas to travel to the action via any of the barrel gas ports. In some embodiments, each of the barrel gas ports may be continuously fluidically connected with the action between a point at or upstream of an inner surface of the barrel to the action. For example, each of the plurality of barrel gas ports may comprises a respective port entrance that is defined by the inner surface of the barrel and defines a respective length dimension and a respective width dimension, as described herein. For example, each of the respective length dimensions of the respective port entrances of the plurality of barrel gas ports may be is greater than the corresponding width dimension.

In various embodiments, an exemplary barrel 16 may comprise an inner surface 104 having rifling configured to impart spin to a projectile as the projectile is propelled along the length of the barrel 16 during discharge of the firearm. For example, FIGS. 9A-11B illustrate various views of exemplary barrels having one or more rifling elements defined along an inner surface of the barrel according to various embodiments described herein, with FIGS. 7A-7B showing the port entrance 111 defined entirely within a rifling groove 161, FIGS. 8A-8B showing the port entrance defined on a rifling land 162, and FIGS. 9A-9B showing the port entrance 111 defined across an edge between the rifling land 162 and rifling groove 161.

Figure 7A:
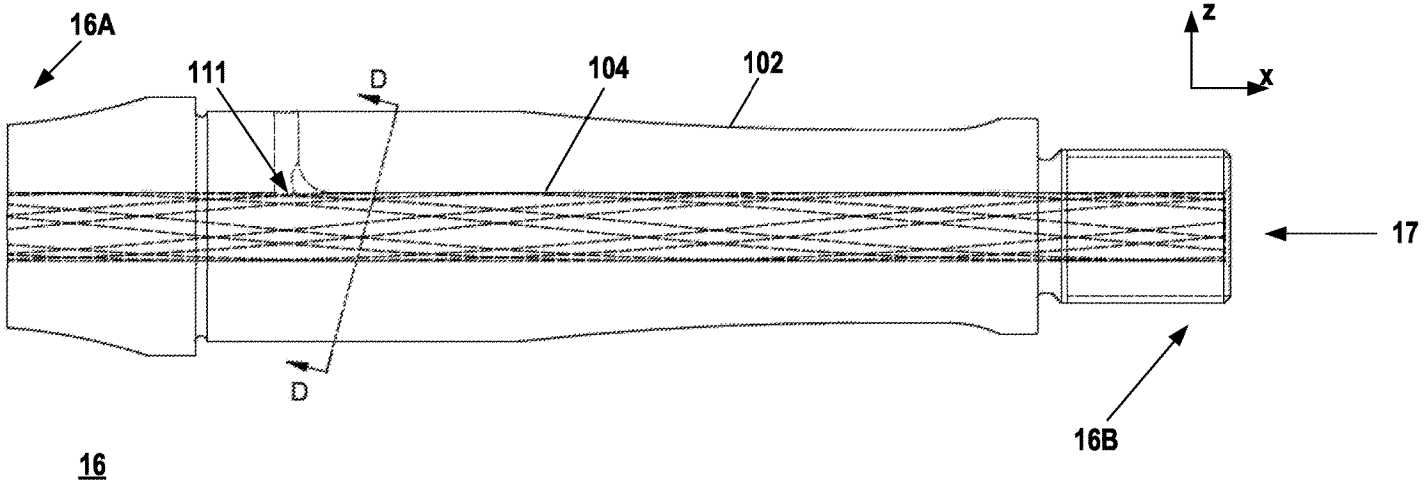
FIG. 7A illustrates a cross-sectional side view of an exemplary barrel comprising an inner surface having rifling according to an example embodiment described herein.
Figure 8A:
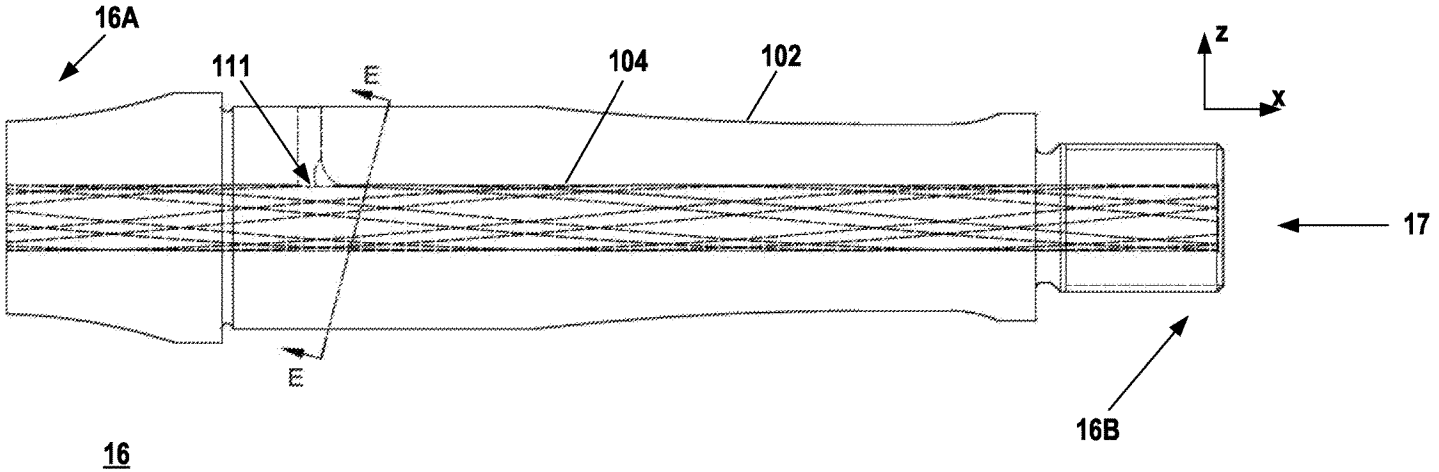
FIG. 8A illustrates a cross-sectional side view of an exemplary barrel comprising an inner surface having rifling according to an example embodiment described herein.
Figure 8B:
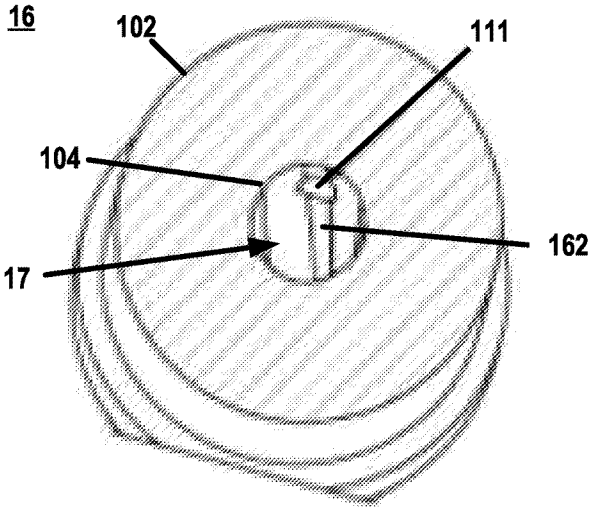
FIG. 8B is a cross-section view of the barrel of FIG. 8A taken along section line "E-E"
Figure 9A:
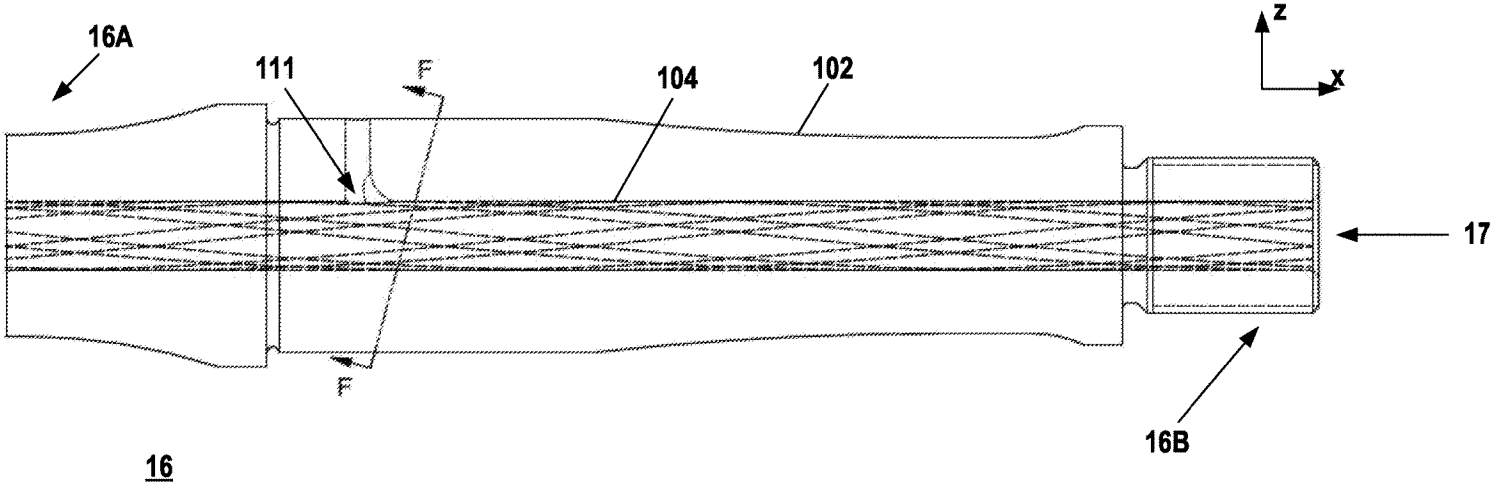
FIG. 9A illustrates a cross-sectional side view of an exemplary barrel comprising an inner surface having rifling according to an example embodiment described herein.
Figure 9B:
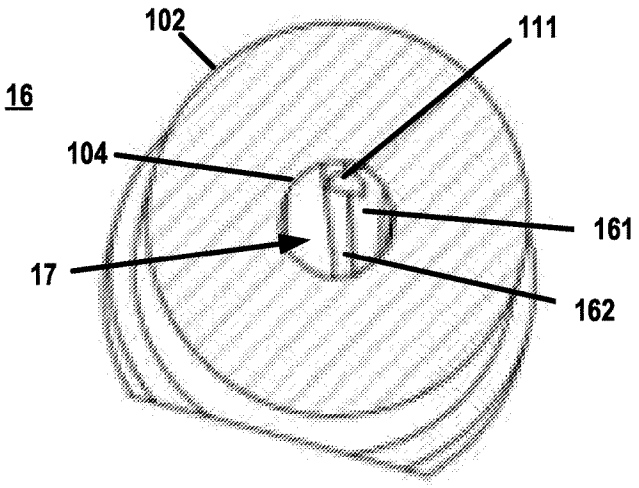
FIG. 9B is a cross-section view of the barrel of FIG. 9A taken along section line "F-F"

In particular, FIGS. 7A, 8A, and 9A illustrate cross-sectional side views of exemplary barrels 16 each comprising an inner surface 104 having rifling defined by one or more rifling elements along the inner surface 104, such as, for example, one or more rifling grooves and/or rifling lands. In various embodiments, one or more rifling elements defined along an inner surface 104 of a barrel 16 may comprise at least one rifling groove and at least one rifling land. The exemplary barrel 16 embodiments illustrated in FIGS. 7A, 8A, and 9A each comprise a barrel gas port 110 having a port entrance 111 defined by the inner surface 104 of the barrel 16 and configured to fluidically connect the bore 17 extending along a longitudinal axis of the barrel 16 to the barrel gas port 110. The port entrance 111 of the barrel gas port 110 may be defined at least partially within one or more of the rifling elements. In some embodiments, the port entrance 111 of the barrel gas port 110 may be defined on one of the rifling land, the rifling groove, and partially on both the rifling land and the rifling groove. As depicted, the port entrance 111 may vary in shape and depth-position and may include one or more structures of the rifling (e.g., a step between a rifling land and rifling groove) without departing from the scope of the present disclosure.

Figure 7B:
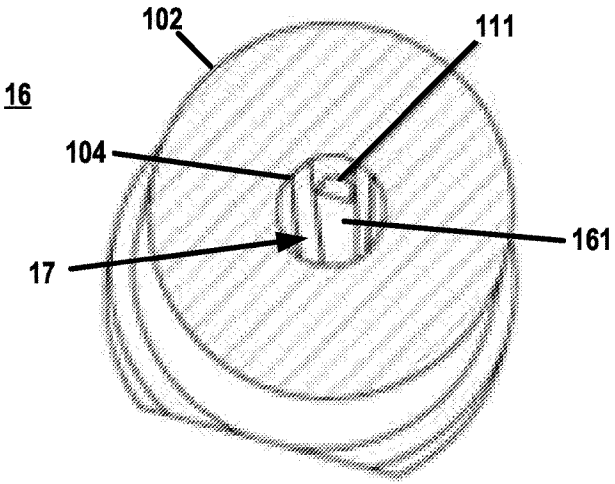
FIG. 7B is a cross-section view of the barrel of FIG. 7A taken along section line "D-D"

For example, FIG. 7B is a cross-section view of the barrel of FIG. 7A taken along section line "D-D". As illustrated, the port entrance 111 of the barrel gas port 110 is defined on one or more rifling elements comprising a rifling groove 161. The port entrance 111 of the barrel gas port 110 is centered on the rifling groove 161. As a further example, FIG. 8B is a cross-section view of the barrel of FIG. 8A taken along section line "E-E". As illustrated, the port entrance 111 of the barrel gas port 110 is defined on one or more rifling elements comprising a rifling land 162. The port entrance 111 of the barrel gas port 110 is centered on the rifling land 162. As a further example, FIG. 9B is a cross-section view of the barrel of FIG. 9A taken along section line "F-F". As illustrated, the port entrance 111 of the barrel gas port 110 is defined partially on a first rifling element comprising a rifling groove 161 and partially on a second rifling element comprising a rifling groove 162. The port entrance 111 of the barrel gas port 110 may bisect the rifling groove 161 and the rifling land 162 such that a first portion of the port entrance 111 is defined on the rifling groove 161 and a second portion of the port entrance 111 is defined on the rifling land 162.

In various embodiments, a barrel 16 comprising an exemplary barrel gas port having a port entrance defined at an inner surface of the barrel and having a length dimension that is greater than a width dimension thereof may be manufactured by one or more manufacturing operations configured to asymmetrically remove an amount of material from a portion of an inner barrel wall of the barrel gas port 110 that includes a muzzle-side edge of a port entrance 111 and/or a portion of the muzzle-side wall surface adjacent thereto. In various embodiments, such exemplary operations may function to increase a length dimension of the port entrance 111 in a direction parallel to the longitudinal axis of the barrel. For example, such exemplary operations may facilitate a barrel gas port configuration wherein the length dimension defined by the port entrance defined at the inner surface 104 of the barrel 16 is greater than a length dimension of the barrel gas port defined in a direction parallel to the longitudinal axis of the barrel at any other location along the gas port depth of the barrel gas port 110 between the port entrance 111 and the port exit 112.

Figure 10B:
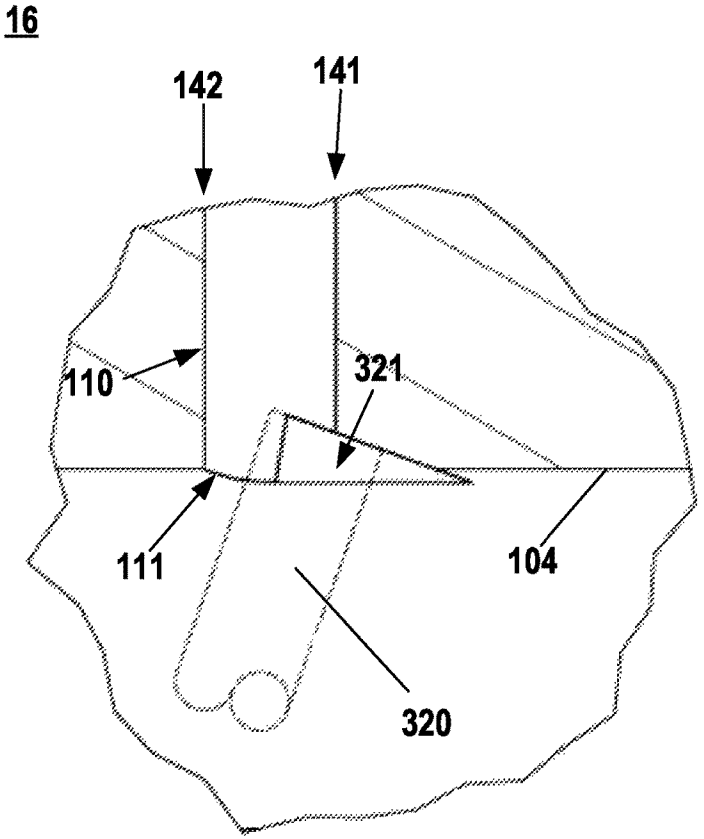
FIGS. 10A-10B illustrate various cross-sectional views of an exemplary barrel having a barrel gas port showing various tool paths according to various embodiments described herein.
Figure 10A:
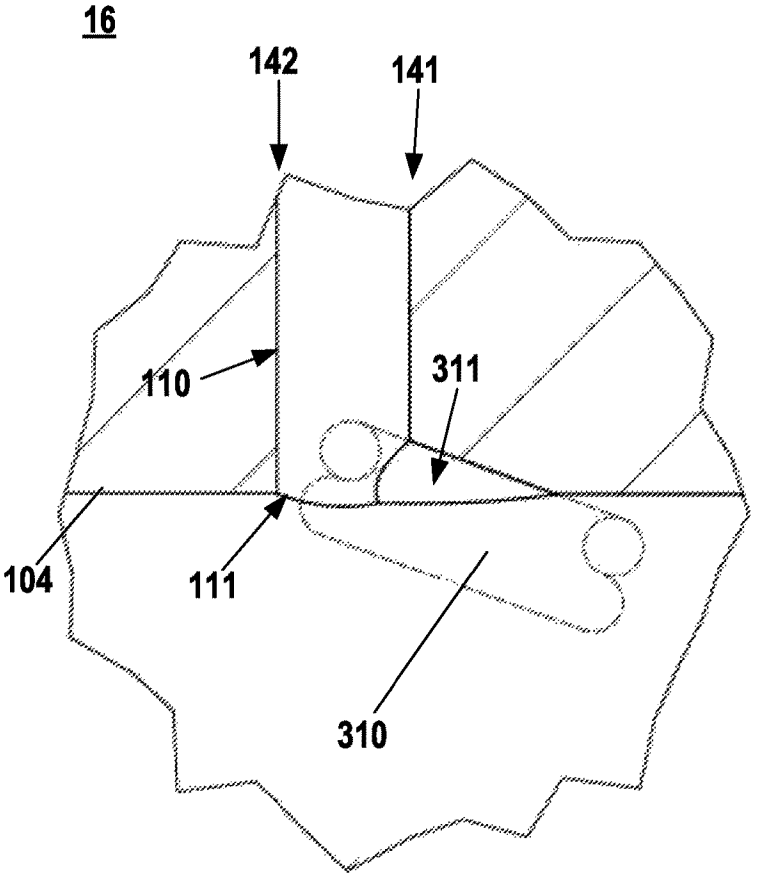

In various embodiments, such as, for example, in the exemplary embodiments illustrated in FIGS. 10A and 10B, various manufacturing operations including one or more milling operations, machining operations, electrical discharge machining (EDM) operations, and/or any other manufacturing operation that may be executed to facilitate a material removal process within an exemplary barrel 16 described herein with respect to various embodiments. For example, one or more of the aforementioned manufacturing processes may be defined by utilizing corresponding machinery to make one or more at least partially cylindrical cuts into the barrel 16, such as, for example, into the inner surface 104 and/or an inner wall of cylindrical barrel gas port, in order to facilitate the asymmetric removal of a material from the muzzle-side portion of the barrel gas port and/or port entrance thereof. For example, as illustrated in FIG. 10A, exemplary manufacturing machinery 310 may be utilized to remove an amount of material 311 from a muzzle-side edge of the port entrance 311. As a further example, illustrated in FIG. 10B, exemplary manufacturing machinery 320 may be utilized to remove an amount of material 321 from a muzzle-side edge of the port entrance 311, which may result in square-profile wedge-shaped cut rather than a cylindrical cut. Such a material removal operation may be executed to cause an increase in a length dimension defined at the port entrance 111 of the barrel gas port 110, while maintaining a width dimension defined at the port entrance 111 of the barrel gas port 110 in order to maintain port entrance 111 in order to minimize the amount of material removed to a minimum amount that is understood to be sufficient to facilitate an evasion of projectile engagement with the barrel gas port 110 during a firing of the firearm.

Many modifications and other embodiments will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of machining a portion of a barrel for a rifle, the method comprising:

providing a barrel for a rifle, the barrel comprising an initial barrel gas port having a gas port depth extending between a port entrance defined by an inner surface of the barrel and a port exit, wherein the port entrance defines a length dimension defined parallel to a longitudinal axis of the barrel and a width dimension defined perpendicular to the length dimension, the inner surface defining rifling; and removing, via one or more subtractive manufacturing processes, an amount of material asymmetrically along at least a portion of a muzzle-side edge of the port entrance to form a machined barrel gas port, wherein the length dimension of the port entrance for the machined barrel gas port is greater than the width dimension of the port entrance, and wherein a center point of the length dimension of the port entrance of the machined barrel gas port extends further towards a muzzle of the barrel than the port entrance of the initial barrel gas port.

2. The method of claim 1, wherein removing the amount of material along the at least the portion of the muzzle-side edge of the port entrance comprises making one or more at least partially cylindrical cuts into the barrel.

3. The method of claim 1, wherein removing the amount of material along the at least the portion of the muzzle-side edge of the port entrance comprises making one or more square-profile wedge-shaped cuts into the barrel.

4. The method of claim 1, wherein upon removing the amount of material from the muzzle-side edge of the port entrance, a center point of the length dimension of the port entrance is located closer to a muzzle end of the barrel than a center point of a second length dimension of the machined barrel gas port defined between the port entrance and the port exit.

5. The method of claim 4, wherein upon removing the amount of material from the muzzle-side edge of the port entrance, the length dimension of the port entrance is greater than the second length dimension of the machined barrel gas port defined parallel to the longitudinal axis between the port entrance and the port exit.

6. The method of claim 4, wherein upon removing the amount of material from the muzzle-side edge of the port entrance, the width dimension of the port entrance is equal to a second width dimension of the machined barrel gas port defined at a location of the second length dimension.

7. The method of claim 4, wherein the length dimension is between 0.5 times and 3.0 times greater than the second length dimension.

8. The method of claim 1, wherein removing the amount of material along the at least the portion of the muzzle-side edge of the port entrance comprises removing the amount of material by cutting at least partly radially and at least partly along the longitudinal axis of the barrel.

9. The method of claim 1, wherein removing the amount of material along the at least the portion of the muzzle-side edge of the port entrance comprises removing a greater amount of material from the muzzle-side edge than along an opposite edge of the port entrance.

10. The method of claim 1, wherein removing the amount of material along the at least the portion of the muzzle-side edge of the port entrance comprises removing a greater amount of material from the muzzle-side edge than from either edge of the port entrance along the width dimension.

11. A barrel for a rifle, the barrel defining:

an inner surface defining rifling; and a barrel gas port having a gas port depth extending between a port entrance defined by the inner surface of the barrel and a port exit, wherein:

the port entrance defines a length dimension defined parallel to a longitudinal axis of the barrel and a width dimension defined perpendicular to the length dimension, and at least a portion of a muzzle-side edge of the port entrance comprises a machined surface machined asymmetrically along at least the portion of the muzzle-side edge of the port entrance such that the length dimension of the port entrance for the barrel gas port is greater than the width dimension of the port entrance and a center point of the length dimension of the port entrance is offset towards a muzzle end of the barrel.

12. The barrel of claim 11, wherein the length dimension of the port entrance is greater than a second length dimension of the barrel gas port defined parallel to the longitudinal axis at a transition region between the port entrance and the port exit.

13. The barrel of claim 12, wherein the length dimension is between 0.5 times and 3.0 times greater than the second length dimension.

14. The barrel of claim 11, wherein the width dimension of the port entrance is equal to a second width dimension of the barrel gas port defined parallel to the longitudinal axis at a transition region between the port entrance and the port exit.

15. The barrel of claim 14, wherein the transition region comprises a larger surface area within the barrel gas port on a muzzle side of the barrel gas port than on an action side of the barrel gas port.

16. The barrel of claim 11, wherein a muzzle-side wall surface of a transition region between the port entrance and the port exit comprises a complex curvature defined by a first radius of curvature defined in a first plane and a second radius of curvature defined in a second plane.

17. The barrel of claim 11, wherein the barrel gas port extends through the barrel between the port entrance defined in a bore of the barrel and the port exit defined by an outer surface of the barrel.

18. A rifle comprising:

a barrel defining:

an inner surface defining rifling; and a barrel gas port having a gas port depth extending between a port entrance defined by the inner surface of the barrel and a port exit, wherein:

the port entrance defines a length dimension defined parallel to a longitudinal axis of the barrel and a width dimension defined perpendicular to the length dimension, and at least a portion of a muzzle-side edge of the port entrance comprises a machined surface machined asymmetrically along at least the portion of the muzzle-side edge of the port entrance such that the length dimension of the port entrance for the barrel gas port is greater than the width dimension of the port entrance and a center point of the length dimension of the port entrance is offset towards a muzzle end of the barrel.

19. The rifle of claim 18, further comprising an action and a gas block engaged with the barrel at a location of the port exit of the barrel gas port, wherein the barrel gas port is configured to fluidically connect the action of the rifle with a bore of the barrel via the barrel gas port.

20. The rifle of claim 19, wherein the rifle is an AR-15 platform rifle.

* * * * *